US012751543B2

(12) United States Patent
Lore et al.

(10) Patent No.: US 12,751,543 B2
(45) Date of Patent: Oct. 6, 2026

(54) FOLDING TABLE AND HINGE ASSEMBLY THEREFOR

(71) Applicant: Live Edge Design Inc., Duncan (CA)

(72) Inventors: John Lore, Duncan (CA); Katie McIlveen, Victoria (CA); Peter Brown, Victoria (CA)

(73) Assignee: LIVE EDGE DESIGN INC., Duncan (CA)

( * ) Notice: Subject to any disclaimer, the term of this patent is extended or adjusted under 35 U.S.C. 154(b) by 198 days.

(21) Appl. No.: 18/362,514

(22) Filed: Jul. 31, 2023

(65) Prior Publication Data

US 2024/0057760 A1 Feb. 22, 2024

Related U.S. Application Data

(60) Provisional application No. 63/399,592, filed on Aug. 19, 2022.

(51) Int. Cl.
*A47B 3/00* (2006.01)
*A47B 3/083* (2006.01)

(52) U.S. Cl.
CPC ..... *A47B 3/083* (2013.01); *A47B 2003/0835* (2013.01)

(58) Field of Classification Search
CPC ..... E05D 11/1007; E05D 11/105; E05D 5/06; A47B 3/08; A47B 2003/0821; A47B 2003/0806
USPC ..... 16/335, 388, 389, 230, 231, 331, 374, 16/321, 324, 326; 108/125, 127, 129, 108/156, 132; 248/188, 188.6
See application file for complete search history.

(56) References Cited

U.S. PATENT DOCUMENTS 244,058 A 7/1881 Hoek
510,082 A * 12/1893 Mullins ..... E05D 11/00 16/343
574,091 A 12/1896 Irvine, Jr.
645,704 A 3/1900 Downs
(Continued)

FOREIGN PATENT DOCUMENTS

CN 108338527 A 7/2018
CN 107802107 B 5/2020
(Continued)

OTHER PUBLICATIONS

KR200142657 English translation (Year: 1999).*
DE3516178 English abstract (Year: 1986).*

*Primary Examiner* — Janet M Wilkens
(74) *Attorney, Agent, or Firm* — Nicholas Garner; Oyen Wiggs Green & Mutala LLP

(57) ABSTRACT

There is provided a hinge assembly including a first hinge member connectable to a leg of a table. The hinge assembly includes a second hinge member hingedly coupled to the first hinge member. The second hinge member includes an outer flange connectable an underside of a tabletop of the table. The second hinge member includes an angled member coupled to the outer flange thereof. A brace which is triangular in side profile, is formed by the angled member and a portion of the tabletop coupled thereto. The hinge assembly may include a locking mechanism which selectively couples together the hinge members. The locking mechanism is configured to self-tighten as the first hinge member is moved towards the second hinge member.

20 Claims, 7 Drawing Sheets

(56) References Cited

U.S. PATENT DOCUMENTS 853,872 A * 5/1907 Gebhardt ..... E05D 11/10 16/343
919,154 A * 4/1909 Gen
1,101,992 A * 6/1914 Booraem ..... A47B 3/08 108/125
1,456,574 A * 5/1923 Roberts ..... A47B 3/0818 16/349
1,459,539 A 6/1923 Henry
2,275,353 A * 3/1942 Engert ..... A47B 13/021 16/346
2,666,673 A * 1/1954 Hughes ..... A47B 3/0917 403/85
3,695,567 A 10/1972 Weagle
3,710,416 A * 1/1973 Phelps ..... E05D 5/065 16/390
4,034,684 A 7/1977 Carson et al.
4,059,058 A * 11/1977 Kazuhide ..... A47B 3/08 16/389
4,063,330 A * 12/1977 Triplette ..... E05D 11/1014 16/337
4,079,679 A * 3/1978 Bechtold ..... A47B 3/0815 248/439
4,449,542 A 5/1984 McSwain et al.
5,740,822 A 4/1998 Einck
5,887,530 A 3/1999 Muller
6,178,979 B1 1/2001 Galloway
6,247,744 B1 * 6/2001 Townsend ..... E05F 7/005 16/388
D493,350 S * 7/2004 Wegman ..... D8/323
6,779,466 B2 8/2004 Shabram, Jr.
7,814,621 B1 * 10/2010 Radke ..... E05D 11/1014 16/388
8,381,749 B1 2/2013 Ashmore, Jr.
8,875,723 B2 11/2014 Brown
10,149,574 B1 12/2018 Harder et al.
10,161,158 B2 12/2018 Mummert
10,492,616 B2 12/2019 Warner
10,537,170 B2 1/2020 McDaniel
2004/0034969 A1 * 2/2004 Wegman ..... E05D 5/06 16/389
2005/0263045 A1 12/2005 Lietuvietis
2006/0150346 A1 7/2006 Myrick et al.
2010/0058958 A1 3/2010 Christian et al.

FOREIGN PATENT DOCUMENTS

CN 223048633 U * 7/2025
DE 1153500 B * 8/1963
DE 3516178 A * 11/1986
DE 102008029320 B3 * 7/2009 ..... F24C 15/04
FR 1099001 A 8/1955
FR 2844173 A1 3/2004
GB 2581381 A * 8/2020 ..... E05D 11/10
KR 200142657 Y1 * 6/1999 ..... A47B 3/08
KR 101536893 B1 * 7/2015 ..... E05D 11/10
NL 1004754 C1 6/1998
NL 2012371 B1 11/2015
WO 2015130671 A1 9/2015
WO 2015132405 A1 9/2015
WO 2017025121 A1 2/2017

* cited by examiner

FOLDING TABLE AND HINGE ASSEMBLY THEREFOR

CROSS REFERENCE TO RELATED APPLICATIONS

This application is a non-provisional of U.S. Provisional Patent Application No. 63/399,592 filed in the United States Patent and Trademark Office on 19 Aug. 2022, and the disclosure of which is incorporated herein by reference and priority to which is claimed.

BACKGROUND OF THE INVENTION

Field of the Invention

There is provided a folding table. In particular, there is provided a folding table and hinge assembly therefor.

Description of the Related Art

U.S. Pat. No. 1,459,539 to Kruesheld discloses a leg for a cooking utensil. The leg has a flange at the top adapted to fit against the bottom of the utensil. The bottom has a slot. The flange has a tongue engaging in the slot and also has an off-set part. The leg includes a clamping member fixed to the bottom of the utensil. The clamping member has a hooked portion engaging the off-set part.

U.S. Pat. No. 4,034,684 to Carson et al. discloses a foldable leg assembly for dual-height workbenches and like devices. The assembly may be simple to construct, may require no foldable braces or stays, and may employ a hinge plate structure to connect same to a workbench base. The legs are oriented and arranged to provide adequate stability in the higher position of the workbench. The dual height workbench includes top members defining a working surface, a base defining longitudinal and transverse axes and support structure for supporting said top members above said base. A plurality of leg members are pivotally attached to said base adjacent outer edge portions of same and movable between inwardly folded inoperative positions corresponding to the lower height of the workbench and outwardly and downwardly inclined operative positions relative to said base corresponding to the higher position of the workbench. The pivotal attachment of the respective legs is such that each of said legs is capable of movement in an arc lying in a plane which is at an acute angle relative to the longitudinal and transverse axes of said base. Each said leg includes at its upper end pivot axis defining means, with a portion of said upper end spaced from said pivot axis defining means being shaped to transmit thrust forces to said base and to limit the degree of outward pivotal motion of said leg thus to define the outwardly and downwardly inclined operative position of each leg.

United States Patent Application Publication No. 2005/0263045 A1 to Lietuvietis discloses a folding table. The folding table has a fastener to releasably hold each of one or more legs, rigidly attached to a rotational leg supportive structural shaft parallel and adjacent to the underside of the table. The legs can be fastened or unfastened into/from an erect position by a rotational leverage force applied to the leg. The fastener provides a manually breakable and engagable grip between two surfaces being fastened to each other. The primary resistance of such a table against collapse is due to the limit of the legs' opening rotational travel, the frictional force of the floor on the legs, and the rotational sets of table legs being configured substantially oppositely. In a four-legged rectangular table configuration, when using such fasteners, each pair of legs is rigid in the opposite direction, providing overall table rigidity. Also encompassed is a variation permitting non-releasing leg latching, including a latch release mechanism.

International Patent Application Publication No. WO2015/130671A1 to Illulian discloses a folding furniture piece has a planar member with first and second parts with outer perimeters and adjacent straight sides hinged to each other. A plurality of support beams extend on inner surfaces of the parts and at least along the outer perimeters and inner straight sides of each part. Each side beam has at least one locking bore and the locking bores are coaxial when the planar member is in the use condition to receive a locking pin to lock the use condition in place. A plurality of legs are movably connected to the planar member for supporting the planar member above a floor in the use condition.

The above-described prior art may suffer a number of disadvantages.

BRIEF SUMMARY OF INVENTION

There is provided, and it is an object to provide, an improved folding table and hinge assembly therefor disclosed herein.

There is accordingly provided a hinge according to one aspect. The hinge includes a first hinge member that is L-shaped. The hinge includes a second hinge member hingedly coupled to the first hinge member. The second hinge member is L-shaped at least in part.

There is also provided a hinge according to another aspect. The hinge includes a first hinge member. The hinge includes a female member coupled to the first hinge member. The hinge includes a second hinge member hingedly coupled to the first hinge member. The hinge includes a male member pivotally coupled to the second hinge member. The male member is configured to selectively engage with the female member, with movement of the first hinge member relative to the second hinge member being inhibited thereby.

There is further provided a hinge according to an additional aspect. The hinge includes a first hinge member. The first hinge member includes a first portion and a second portion coupled and extending either perpendicular or slightly obtusely angled relative to the first portion thereof. The hinge includes a second hinge member including a first portion hingedly coupled to the first portion of the first hinge member. The second hinge member includes a second portion coupled and extending either perpendicular or slightly obtusely angled relative to the first portion thereof. The second hinge member includes a third portion angularly spaced-apart from and coupled to the first portion thereof via the second portion thereof.

There is yet also provided a hinge according to a further aspect. The hinge includes a first hinge member. The hinge includes a second hinge member hingedly coupled to the first hinge member. The hinge includes a latching mechanism configured to self-tighten as the first hinge member is moved towards the second hinge member.

There is also provided a hinge according to another aspect. The hinge includes a first hinge member. The hinge includes a second hinge member hingedly coupled to the first hinge member. One of the hinge members is V-shaped at least in part in side profile.

There is further provided a hinge according an additional aspect. The hinge includes a first hinge member. The hinge includes a second hinge member hingedly coupled to the first hinge member. One of the hinge members is both L-shaped at least in part and V-shaped at least in part in side profile.

There is yet also provided a hinge according a further aspect. The hinge includes a first hinge member. The hinge includes a second hinge member hingedly coupled to the first hinge member. One of the hinge members in use is triangular at least in part in side profile.

There is yet further provided a hinge according to an additional aspect. The hinge includes a first hinge member. The hinge includes a second hinge member hingedly coupled to the first hinge member. One of the hinge members includes a proximal end portion, a distal end portion spaced-apart from the proximal end portion thereof, and an angled portion which couples and extends outwards from the end portions at obtuse angles relative to the end portions thereof There is also provided a hinge according to yet an additional aspect. The hinge includes a first hinge member. The hinge includes a second hinge member hingedly coupled to the first hinge member. One of the hinge members includes spaced-apart end portions which extend parallel with each other and includes an angled portion extending therebetween.

There is further provided a hinge assembly according to one aspect. The hinge assembly includes a first hinge member and a second hinge member hingedly coupled to the first hinge member. The hinge assembly includes a brace coupled to and integrally formed with one of the hinge members. The hinge assembly includes a locking mechanism. The locking mechanism includes a female member coupled to one of the hinge members and a male member coupled to another of the hinge members.

There is additionally provided a combination brace and hinge assembly according to one aspect. The combination brace and hinge assembly includes a brace. The brace includes a pair of spaced-apart flanges. The brace includes an angled member coupled to and extending between the flanges thereof. The brace includes a plurality of laterally spaced-apart hollow protrusions with recessed portions therebetween. The hollow protrusions couple to a distal end of one said flange. The combination brace and hinge assembly includes a hinge member. The hinge member includes a plurality of laterally spaced-apart hollow protrusions positioned to fit within respective said recessed portions. The combination brace and hinge assembly includes a pin member. The pin member is shaped to extend through said hollow protrusions, with the one said flange of the brace and the hinge member pivotally coupling together thereby.

There is further provided a folding table according to one aspect. The folding table includes a tabletop. The folding table includes at least one hinge as described above. The folding table includes at least one leg coupled to the tabletop via the at least one hinge.

There is also provided a folding table according to another aspect. The folding table includes at least one leg. The folding table includes a tabletop. The folding table includes a first hinge member. The first hinge member includes first and second portions coupling to and extending at least in part along an end and an outer side of the leg, respectively. The folding table includes a second hinge member hingedly coupled to the first hinge member. The hinge members enable the leg to move relative to the tabletop from a stored position to a deployed position. The second hinge member abuts and extends along at least one of the first and second portions of the first hinge member in said deployed position.

There is yet also provided a folding table according to an additional aspect. The folding table includes a tabletop. The folding table includes at least one leg. The folding table includes a hinge mechanism coupled to the tabletop and the leg so as to enable the leg to move from a stored position to a deployed position. The folding table includes a brace configured to support the leg in the deployed position. The brace is integrally connected to and formed with the hinge mechanism.

There is yet further provided a folding table according to a further aspect. The folding table includes a tabletop. The folding table includes at least one leg. The folding table includes a hinge mechanism coupled to the tabletop and the leg so as to enable the leg to move from a stored position to a deployed position. The folding table includes a locking mechanism which when actuated is configured to inhibit movement of the leg from the deployed position to the stored position. The locking mechanism is integrally connected to and formed with the hinge mechanism.

It is emphasized that the invention relates to all combinations of the above features, even if these are recited in different claims.

Further aspects and example embodiments are illustrated in the accompanying drawings and/or described in the following description.

BRIEF DESCRIPTION OF DRAWINGS

The accompanying drawings illustrate non-limiting example embodiments of the invention.

DESCRIPTION OF THE PREFERRED EMBODIMENTS

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
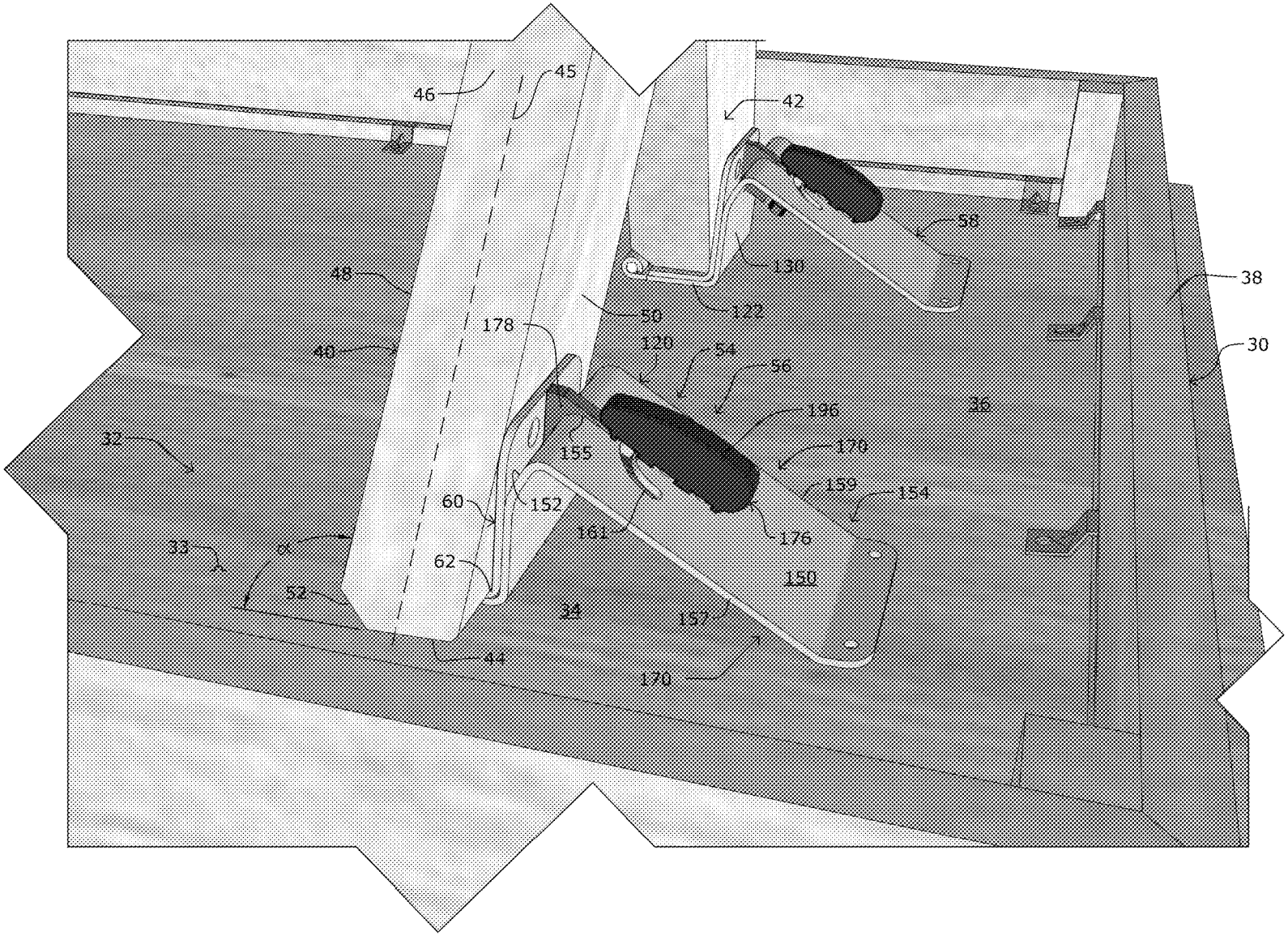
FIG. 1 is a bottom, side perspective view of a folding table according to one aspect, the folding table shown in fragment and including a tabletop, hinge assemblies, and a plurality of legs coupled to an underside of the tabletop via the hinge assemblies, with the legs being shown in deployed positions, with the hinge assemblies including latching mechanism shown in deployed and latched positions.

Referring to the drawings and first to FIG. 1, there is provided a table, in this example a folding table 30.

The table includes a planar member, in this example tabletop 32. The tabletop is generally planar and has an underside 33 facing the floor (not shown) when in use. Tabletop 32 includes a central portion 34 and a peripheral portion 36 extending about the central portion thereof. Table 30 in this non-limiting embodiment includes an apron or skirt 38. The skirt couples to peripheral portion 36 of the table and extends outwards from tabletop 32; however, a skirt is not strictly required.

Table 30 includes at least one and in this example a plurality of legs 40 and 42. Each leg is generally a rectangular prism in shape in this non-limiting embodiment; however, this is not strictly required and the legs may have other shapes in other embodiments. Each leg 40 has a first or proximal end 44 adjacent tabletop 32 and a second or distal end 46 spaced-apart from the proximal end thereof. The distal ends of the legs are shaped to abut the floor (not shown). Each leg 40 has a longitudinal axis 45 extending between ends 44 and 46 thereof.

Each leg has an inner side 48 facing inwards at least in part and opposite nearby peripheral portion 36 of tabletop 32. Each leg 40 has an outer side 50 opposite the inner side thereof. The outer side of leg 40 faces laterally outwards from table 30 and towards nearby peripheral portion 36 of tabletop 32 in this example. For each leg, sides 48 and 50 thereof extend between ends 44 and 46 thereof. Each leg 40 in this non-limiting embodiment has a recessed or cut-out portion 41 having a sloping surface or bevel 52; however, this is not strictly required. For each leg, the bevel thereof extends between and is angled relative to inner side 48 thereof and proximal end 44 thereof.

Legs 40 and 42 have extended or deployed positions seen in FIG. 1. Proximal ends 44 of the legs extend along and are adjacent underside 33 of tabletop 32 when the legs are in the deployed position in this example. The proximal ends of legs 40 and 42 extend parallel to the tabletop when the legs are deployed in this non-limiting embodiment. Distal ends 46 of the legs are configured to abut the floor (not shown) when the legs are in the deployed position. Legs 40 and 42 in their deployed positions function to place table 30 and tabletop 32 thereof in an upright or elevated position.

The legs extend downwards and laterally outwards in part relative to underside 33 of the tabletop in this example; however, this is not strictly required and the legs may extend substantially perpendicular to the tabletop in the deployed position in other embodiments, for example. Legs 40 extend downwards and laterally slightly outwards from the underside of the tabletop in this example by angle $\alpha$ relative to the underside of the tabletop. Angle $\alpha$ is slightly obtuse in this non-limiting embodiment, being slightly greater than 90 degrees; however, again this is not strictly required and angle $\alpha$ may be equal to 90 degrees in other embodiments or be slightly acute in still further embodiments.

There is provided a hinge assembly 54. The hinge assembly may be said to be a part of table 30; however, this is not strictly required and the hinge assembly may comprise a distinct set of components that may be sold separately and/or may be retrofitted onto an existing and/or third party table for example. Hinge assembly 54 includes a plurality of hinges 56 and 58. Legs 40 and 42 couple to underside 33 of tabletop 32 via respective ones of the hinges.

Figure 4:
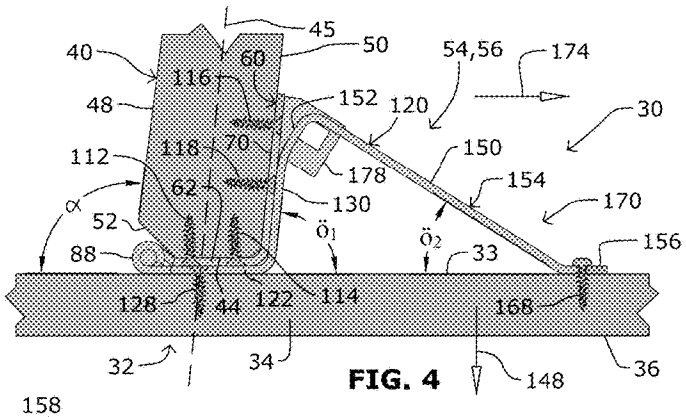
FIG. 4 is a side elevation view of the folding table and one of the hinge assemblies and legs of FIG. 1, with the leg and tabletop of the table shown in fragment and with a latch of the latching mechanism of FIG. 1 not being shown.
Figure 5:
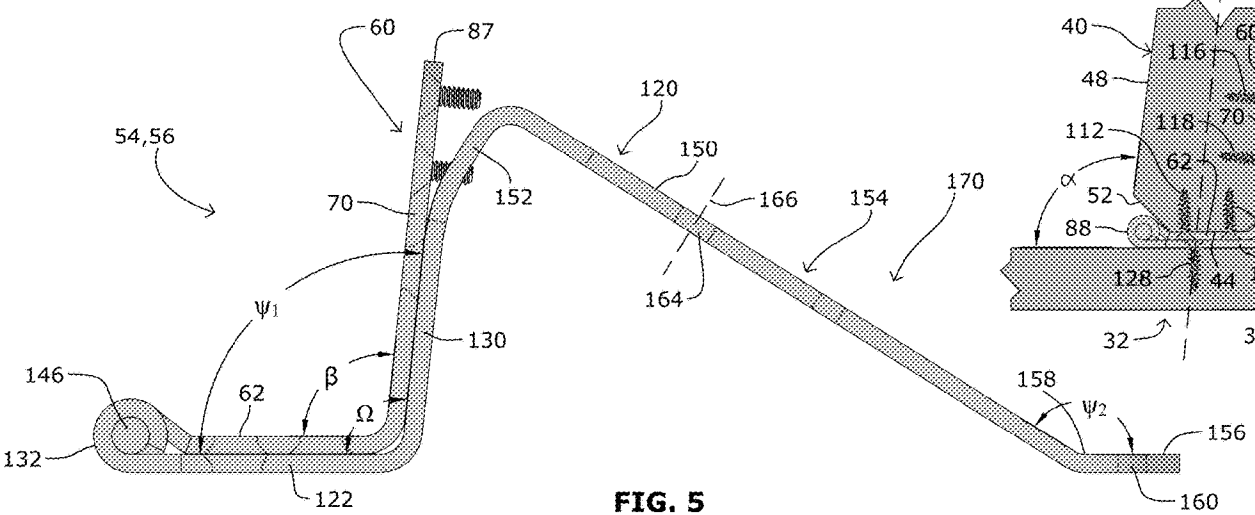
FIG. 5 is a side elevation view of one of the hinge assemblies of FIG. 1 with the latching mechanism thereof not being shown.

As seen in FIG. 5, each hinge 56 includes a first hinge member 60. As seen in FIG. 4, the first hinge member in this example is shaped to extend along proximal end 44 of leg 40 as well as outer side 50 of leg 40. The following is a non-limiting embodiment which may achieve this functionality.

Figure 6:
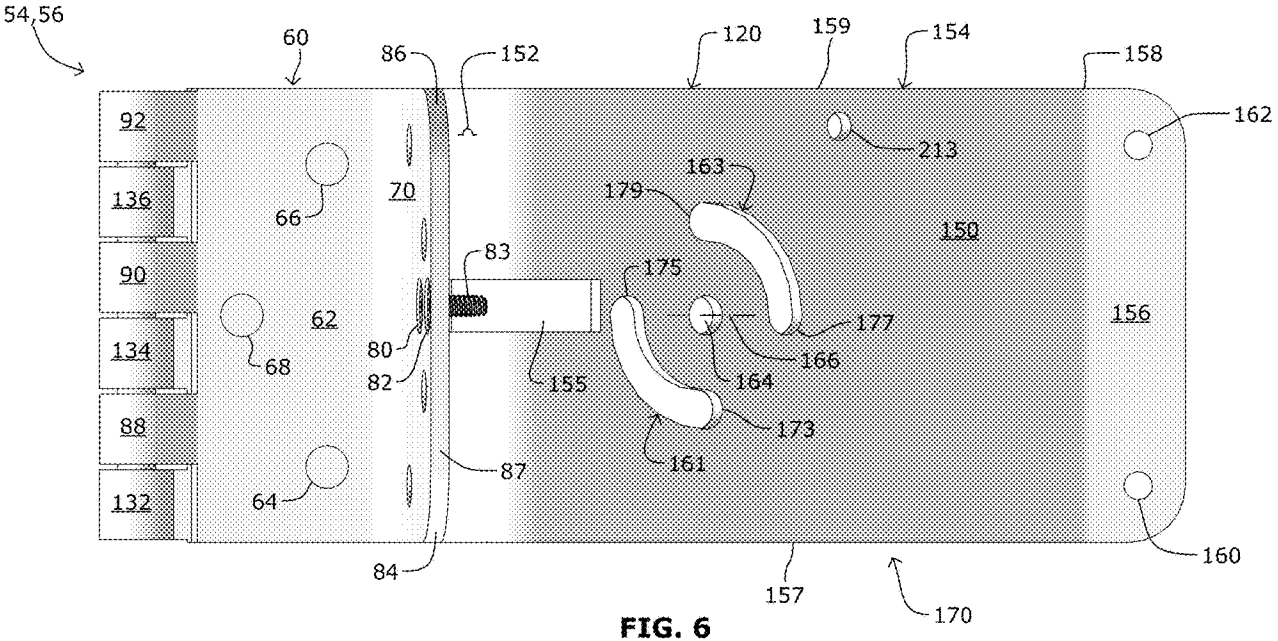
FIG. 6 is a bottom plan view thereof.

First hinge member 60 includes a first portion 62. The first portion in this non-limiting embodiment is planar and may be referred to as a first planar portion of the first hinge member. However this is not strictly required and the first portion may be outwardly concave and/or convex or comprise other shapes in other embodiments. First portion 62 of first hinge member 60 may be referred to as a first hinge leaf. As seen in FIG. 6, the first hinge member has at least one and in this example a plurality of spaced-apart apertures extending therethrough, in this case in the form of spaced-apart of apertures 64, 66 and 68 extending through first portion 62 thereof. Apertures 64 and 66 align with aperture 68 interposed therebetween and offset therefrom in this example. The apertures are generally positioned in a triangular arrangement in this non-limiting embodiment.

Referring back to FIG. 5, first hinge member 60 includes a second portion 70 coupled to and extending outwards from first portion 62 thereof. The second portion in this non-limiting embodiment is planar and may be referred to as a second planar portion of the first hinge member. However this is not strictly required and the second portion may be outwardly concave and/or convex or comprise other shapes in other embodiments. Second portion 70 of first hinge member 60 extends outwards from first portion 62 of the first hinge member at an angle $\beta$ angled relative to the first portion thereof in this non-limiting embodiment. Angle $\beta$ is obtuse in this example. Angle $\beta$ in this example is equal to or greater than 90 degrees and less than 110 degrees in one preferred range. Angle $\beta$ is equal to or greater than 90 degrees and less than 100 degrees in a more preferred range. Angle $\beta$ in one non-limiting embodiment substantially equals to 96 degrees; however, the latter is not strictly required.

First hinge member 60 is thus generally L-shaped in side profile in this example, with second portion 70 thereof extending outwards either perpendicular or at a slightly obtuse angle relative to first portion 62 thereof. The first and second portions of the first hinge member are integrally connected together so as to form a unitary whole in this non-limiting embodiment.

Figure 10:
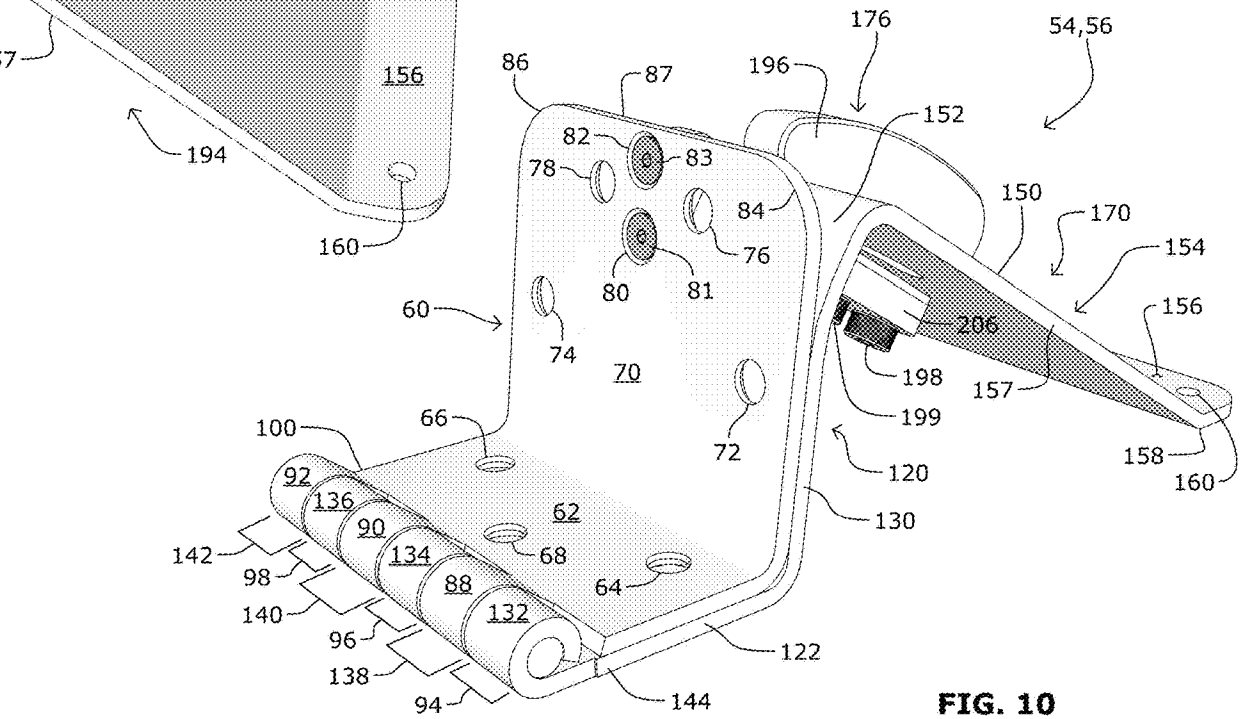
FIG. 10 is an inner end, side perspective view thereof.

As seen in FIG. 10, second portion 70 of first hinge member 60 includes a plurality of apertures extending therethrough, in this example in the form of a first pair of spaced-apart apertures 72 and 74, a second pair of spaced-apart apertures 76 and 78 and a third pair of spaced-apart apertures 80 and 82. Apertures 72 and 74 align and apertures 76 and 78 align laterally and are inwardly spaced from apertures 72 and 74 in this non-limiting embodiment. Apertures 80 and 82 in this example align in a direction perpendicular to apertures 76 and 78 or vertically from the perspective of FIG. 10. Apertures 80 and 82 are inwardly spaced from and interposed between apertures 76 and 78 in this non-limiting embodiment.

First and second portions 62 and 70 of the first hinge member are rectangular in this example; however, this is not strictly required. The first hinge member has rounded corners 84 and 86 along distal end 87 of second portion 70 thereof; however, this is not strictly required. Apertures 76, 78, 80 and 82 are near or adjacent the distal end of the second portion of first hinge member 60 in this non-limiting embodiment.

Still referring to FIG. 10, the first hinge member includes a plurality of laterally spaced-apart hollow protrusions, in this example hinge knuckles 88, 90 and 92 with spaces or recessed portions 94, 96 and 98 therebetween. The hinge knuckles couple to, are integrally formed with, and extend outwards from proximal end 100 of first portion 62 of first hinge member 60. Each leg 40 in this non-limiting embodiment is shaped to accommodate hinge knuckles 88, 90 and 92 seen in FIG. 6, in this non-limiting embodiment via cut-out portion 41 and/or bevel 52 seen in FIG. 4 and shaped to provide space for the hinge knuckles. Each leg is shaped in this example such that the hinge knuckles align flush with or inwardly spaced from inner side 48 thereof.

Figure 2:
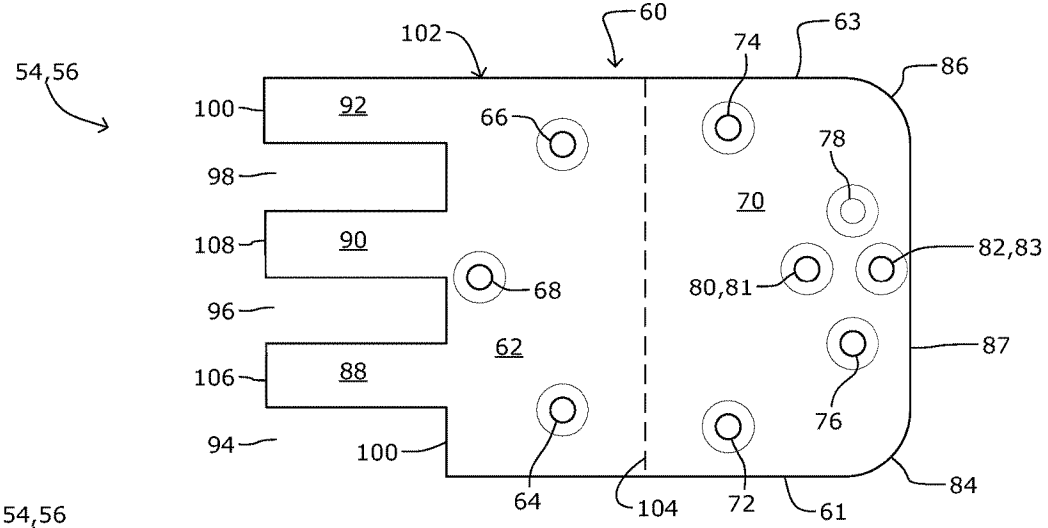
FIG. 2 is a blank of a first hinge member of one of the hinge assemblies of FIG. 1 prior to being folded into shape.

As seen in FIG. 2, the first hinge member is formed in this non-limiting embodiment by a blank 102. The blank is planar and is generally rectangular in this example. Blank 102 is configured to be bent along a laterally-extending bend portion or line 104 positioned between ends 87 and 100 thereof. Still referring to FIG. 2, hinge knuckles 88, 90 and 92 in this example are formed by a plurality of tooth-shaped portions 106, 108 and 110 of blank 102. The tooth-shaped portions are longitudinally-extending and rectangular in shape in this example. Tooth-shaped portions 106, 108 and 110 of blank 102 extend from proximal end 100 towards distal end 87 when first hinge member 60 in its blank form. Each tooth-shaped portions 106, 108 and 110 is rolled or folded about itself so as to form a tubular shape comprising hinge knuckles 88, 90 and 92 seen in FIG. 10.

Figure 7:
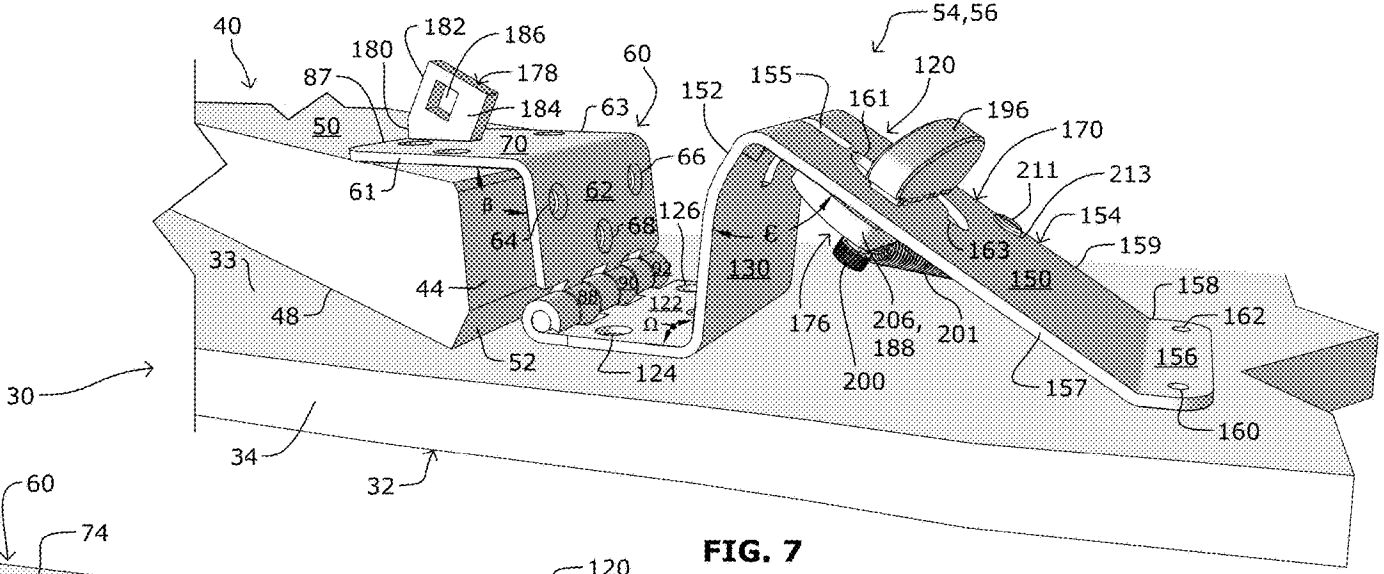
FIG. 7 is a side, bottom perspective view of one of the hinge assemblies of FIG. 1 shown in a stored and unlatched position in which the first hinge member thereof is angularly spaced from the second hinge member thereof, together with the table of FIG. 1 shown in fragment, with one of the legs shown coupled thereto and extending along the tabletop in a stored position.

As seen in FIG. 4, first portion 62 of first hinge member 60 of hinge 56 is configured to extend along, abut and selectively couple to proximal end 44 of leg 40: in this non-limiting embodiment via one or more fasteners, in this example screws 112 and 114 which extend through apertures 64, 66 and 68 seen in FIG. 7 and into the leg. Referring back to FIG. 4, second portion 70 of first hinge member 60 of hinge 56 is shaped to extend along and abut outer side 50 of leg 40. The second portion of the first hinge member of the hinge couples to the outer side of the leg via one or more fasteners, in this example screws 116 and 118 which extend through apertures 72, 74, 76 and 78 seen in FIG. 8 and into the leg. Referring back to FIG. 4, first hinge member 60 is thus configured to effectively increase the surface area of contact between the first hinge member and tabletop 32 when the legs are unfolded.

As seen in FIG. 7, hinge 56 includes a second hinge member 120. First hinge member 60 and second hinge member 120 are made of a rigid material, in this example metal, in this case metal plate; however, this is not strictly required and the hinge members may be made of other materials in other embodiments.

Second hinge member 120 includes a first portion 122. The first portion of the second hinge member is shaped to extend along and abut first portion 62 of first hinge member 60 when hinge assembly 54 is its deployed position seen in FIG. 9. As seen in FIG. 7, first portion 122 of second hinge member 120 is also shaped to extend along and abut underside 33 of tabletop 32. The following is a non-limiting embodiment which may achieve this functionality.

Figure 8:
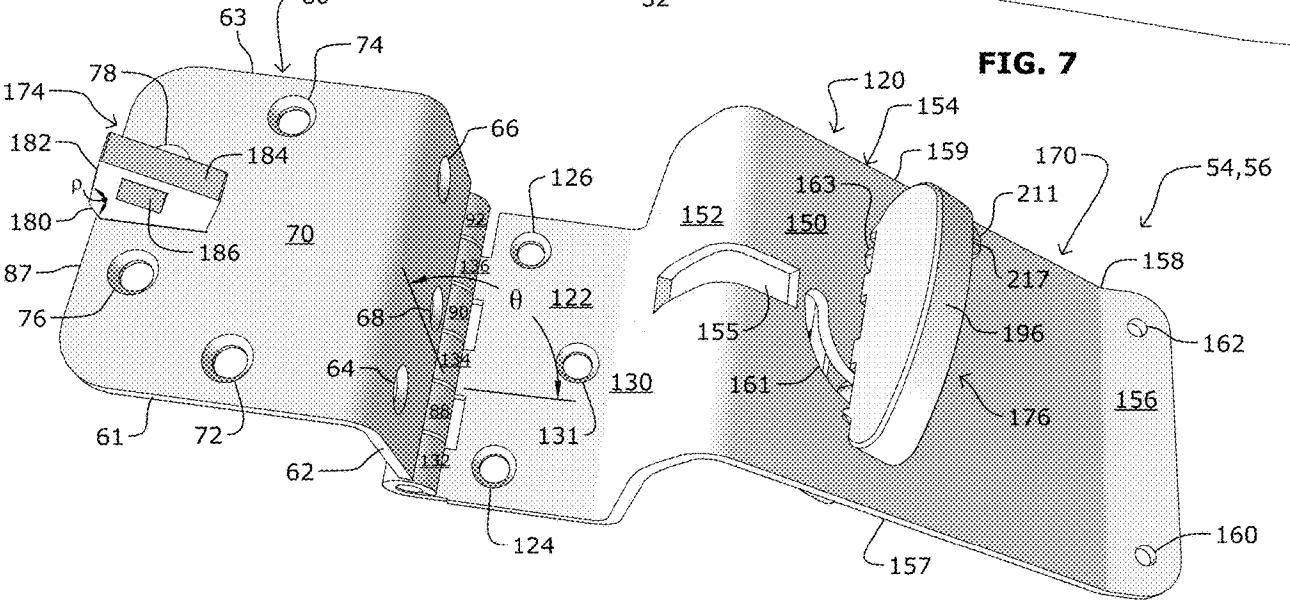
FIG. 8 is a bottom, side perspective view of the hinge assembly of FIG. 7.

First portion 122 of second hinge member 120 in this example is planar and may be referred to as a first planar portion of the second hinge member. However this is not strictly required and the first portion may comprise other shapes in other embodiments. First portion 122 of second hinge member 120 may be referred to as a second hinge leaf of hinge. Referring to FIG. 8, the second hinge member has at least one and in this example a plurality of apertures extending therethrough, in this case including in the form of a set of spaced-apart of apertures 124, 126 and 131 extending through first portion 122 thereof. Apertures 124, 126 and 131 are near or adjacent apertures 64, 66 and 68 of first portion 62 of first hinge member 60 when hinge assembly 54 is shown in its deployed position seen in FIG. 9.

Referring back to FIG. 4, the first portion of the second hinge member is shaped in this example to abut and extend parallel to underside 33 of tabletop 32. First portion 122 of second hinge member 120 extends horizontally, with the second hinge member thus extending horizontally at least in part. In this example hinge assembly 54 includes a plurality of fasteners 128 which extend through apertures 124, 126 and 131 and via which first portion 122 of second hinge member 120 couples to the underside of the tabletop.

As seen in FIG. 7, second hinge member 120 includes a second portion 130 coupled to and extending outwards from first portion 122 thereof. The second portion of the second hinge member in this example is planar and may be referred to as a first planar portion of the second hinge member. However this is not strictly required and the first portion may comprise other shapes in other embodiments. Second portion 130 of second hinge member 120 couples to and extends outwards at an angle Ω angled relative to first portion 122 of the second hinge member. Angle Ω in this example is equal to or greater than 90 degrees and less than 110 degrees in one preferred range. Angle Ω is equal to or greater than 90 degrees and less than 100 degrees in a more preferred range. Angle Ω comprises 96 degrees in one non-limiting embodiment; however, the latter is not strictly required.

Second hinge member 120 is thus generally L-shaped in side profile at least in part, with second portion 130 thereof extending outwards either perpendicular or slightly obtusely angled relative to first portion 122 thereof. Second portion 130 of the second hinge member generally extends vertically. The second hinge member thus extends vertically at least in part. First portion 122 and second portion 130 of second hinge member 120 are integrally connected together so as to form a unitary whole in this non-limiting embodiment.

As seen in FIG. 10, the second hinge member includes a plurality of laterally spaced-apart hollow protrusions, in this example hinge knuckles 132, 134 and 136 with spaces or recessed portions 138, 140 and 142 therebetween. The hinge knuckles couple to, are integrally formed with, and extend outwards from proximal end 144 of first portion 122 of the second hinge member. Hinge knuckles 88, 90 and 92 of first hinge member 60 are shaped to intermesh with hinge knuckles 132, 134 and 136: hinge knuckles 88, 90 and 92 fit within recessed portions 138, 140 and 142 and hinge knuckles 132, 134 and 136 are shaped to fit within recessed portions 94, 96 and 98.

As seen in FIG. 5, hinge assembly 54 includes a pin member, in this example an elongate shaft 146. The elongate shape is shaped to extend through respective hinge knuckles 88, 90, 92, 132, 134, and 136 of first and second hinge members 60 and 120. First portions 62 and 122 of the first and second hinge members hingedly couple together thereby and about the shaft in this example. However, this is not strictly required and hinge members 60 and 120 may pivotally couple together via pintles or other such hinge or pivot mechanisms in other embodiments.

As seen in FIG. 7, first and second hinge members 60 and 120 have a first position or spaced-apart position in which the first hinge member is angularly spaced from the second hinge member. First portion 62 of first hinge member 60 is angularly spaced from first portion 122 of second hinge member 120 by an angle θ in the spaced-apart position of the hinge members. Angle θ may generally be equal to 90 degrees in this example; however this is not strictly required and angle θ may be obtuse or acute in other embodiments. First portion 62 of first hinge member 60 in this non-limiting embodiment extends generally vertically in this example when hinge 56 is in the spaced-apart position and leg 40 is in the stored position seen in FIG. 7. Second portion 70 of the first hinge member in this non-limiting embodiment extends generally horizontally and parallel with sides 48 and 50 of the leg and parallel with underside 33 of tabletop 32 when the hinge is in the spaced-apart position and the leg in the deployed position seen in FIG. 7.

Figure 9:
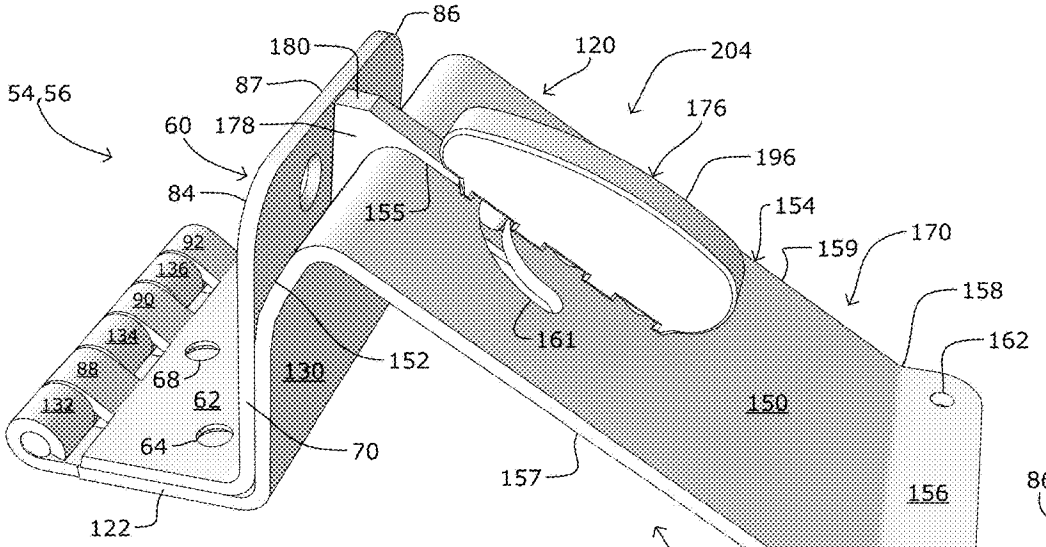
FIG. 9 is a side, bottom perspective view of one of the hinge assemblies of FIG. 1, with the hinge assembly shown in the deployed and latched position.

First and second hinge members 60 and 120 are moveable from the first position thereof to a second position or nested position seen in FIG. 9. The first and second hinge members are moveable to selectively overlap with each other in the nested position thereof. First hinge member 60 is adjacent and extends along second hinge member 120 in the nested position. First portions 62 and 122 of hinge members 60 and 120 extend adjacent and parallel with each other and second portions 70 and 130 of the hinge members extend adjacent and parallel with each other in the nested position. Second hinge member 120 thus abuts and extends along at least one of the first and second portions 62 and 70 of first hinge member 60 in the nested position seen in FIG. 4. First and second portions 122 and 130 of the second hinge member 120 in this example both abut and extend along the first and second portions of the first hinge member in the nested position in this non-limiting embodiment.

First portion 62 of first hinge member 60 in this non-limiting embodiment extends generally horizontally and parallel to underside 33 of tabletop 32 when hinge 56 is in the nested position and leg 40 is in the deployed position seen in FIG. 4. Second portion 70 of the first hinge member in this non-limiting embodiment extends vertically at least in part when the hinge is in the nested position and the leg is in the deployed position.

Each leg 40 is moveable relative to tabletop 32 via hinge members 60 and 120 so coupled thereto from the stored position thereof seen in FIG. 7 to the deployed position thereof seen in FIG. 4. Hinge 56 may be referred to as a hinge mechanism coupled to tabletop 32 and leg 40 so as to enable the leg to move from its stored position seen in FIG. 7 to its deployed position seen in FIG. 4. The hinge members are configured in this example to cause each leg in the deployed position seen in FIG. 4 to extend outwards from tabletop 32 towards peripheral portion 36 of the tabletop at a generally perpendicular and in this example slightly obtuse angle α relative to the tabletop.

Hinge members 60 and 120 are configured to promote positioning of legs 40 in said deployed position and inhibit movement of the legs towards the stored position without one or more active steps being taken. The following is a non-limiting embodiment to achieve this functionality.

Hinge members 60 and 120 are configured to incorporate the weight of tabletop 32 to bias legs 40 outwards and such that the legs are inhibited from moving from deployed to stored positions thereof unless the tabletop is first lifted upwards, as shown by arrow 148. With the hinge members being configured to position legs 40 downwards and outwards at slightly obtuse angle α relative to the tabletop, the weight of the tabletop may function to force/bias the legs to the outside, with the hinge members thereby employing gravity to keep table 30 in a sturdy position and with tabletop 32 needing to rise for the legs to move from folded to unfolded positions.

As seen in FIG. 7, each leg 40 generally extends horizontally and parallel to underside 33 of tabletop 32 in this example in the stored position thereof. The legs in the stored position result in table 30 being more compact and thus suitable for storage purposes when the table is not needed.

Still referring to FIG. 7, second hinge member 120 includes a third portion 150. The third portion of the second hinge member is shaped to support second portion 130 of the second hinge member. Third portion 150 of second hinge member 120 is shaped to inhibit movement of the second portion of the second hinge member relative to first portion 122 of the second hinge member. The following non-limiting embodiment which may achieve this functionality.

Third portion 150 of second hinge member 120 in this example is planar and may be referred to as a third planar portion of the second hinge member. However this is not strictly required and the third portion may comprise other shapes in other embodiments. Third portion 150 of second hinge member 120 is operatively connects to and is angularly spaced-apart from second portion 130 of the second hinge member. The third portion of the second hinge member is angled relative to the second portion of the second hinge member. Third portion 150 of second hinge member 120 extends outwards at an acute angle ε relative to the second portion of the second hinge member. Angle ε is in the range of 45 to 85 degrees in one non-limiting embodiment. Angle ε is in the range of 55 to 75 degrees in another non-limiting embodiment. Angle ε is in the range of 60 to 70 degrees in a further non-limiting embodiment. Angle ε is 64 degrees in this example; however this is not strictly required. Third portion 150 of second hinge member 120 may be referred to as a first angled portion of second hinge member 120.

Second hinge member 120 includes a fourth portion 152 which couples together second portion 130 thereof and third portion 150 thereof. The fourth portion of the second hinge member in this example is planar and may be referred to as a fourth planar portion of the second hinge member. However this is not strictly required and the fourth portion may comprise other shapes in other embodiments. Fourth portion 152 of second hinge member 120 couples to and extends between first and fourth portions 122 and 152 of the second hinge member in this example. The fourth portion of the second hinge member integrally connects to the first and fourth portions of the second hinge member so as to form a unitary whole in this example. Third portion 150 of second hinge member 120 couples and extends outwards from fourth portion 152 of the second hinge member at a right angle in this non-limiting embodiment; however, this is not strictly required. The fourth portion of the second hinge member may be referred to as a second angled portion which is angled relative to the first, second and third portions 122, 130 and 150 of the second hinge member.

As seen in FIG. 8, second hinge member 120 has a first slot 155 that is elongate in this example. The first slot of the second hinge member is centrally positioned between sides 157 and 159 of the second hinge member in this example. First slot 155 extends through fourth portion 152 as well as in part through second and third portions 130 and 150 of second hinge member 120 in this non-limiting embodiment.

Figure 3:
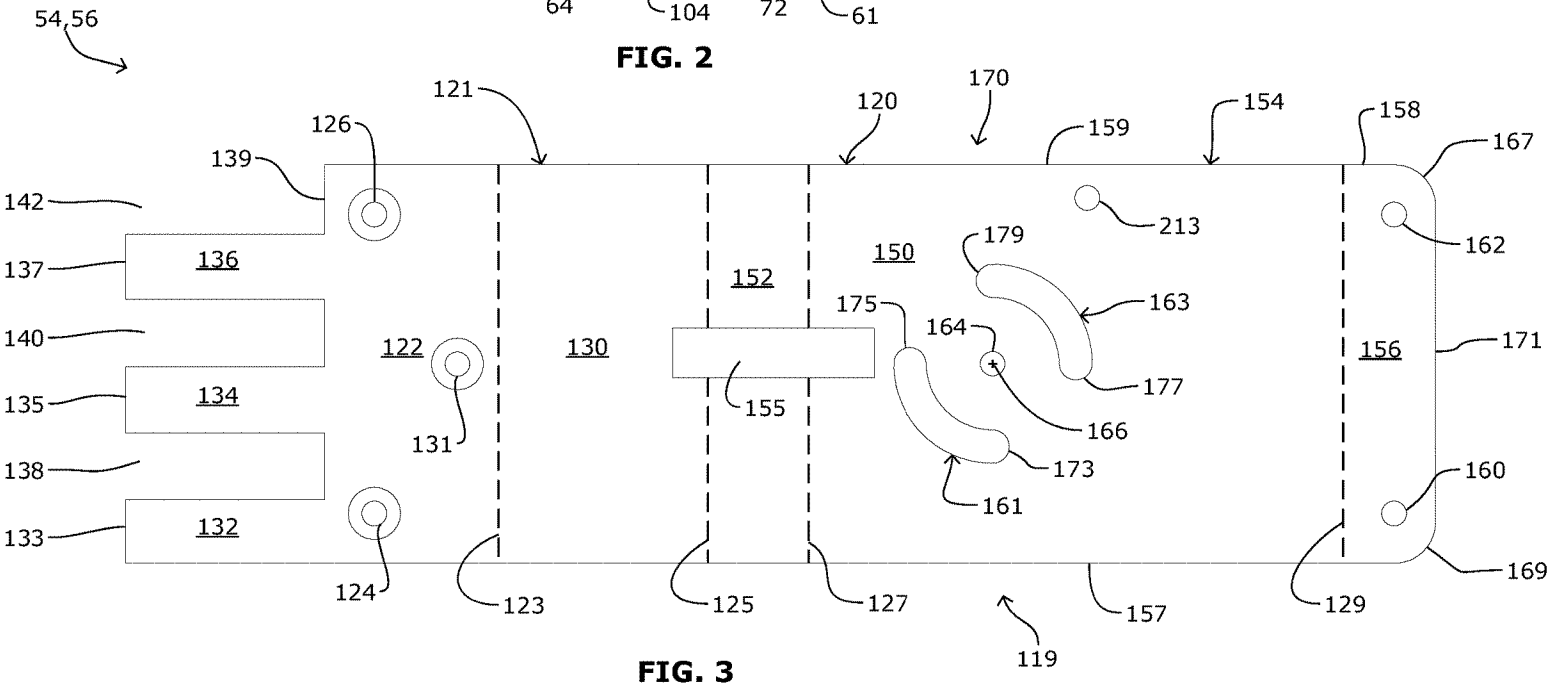
FIG. 3 is a blank of a second hinge member of one of the hinge assemblies of FIG. 1 prior to being folded into shape.

As seen in FIG. 6, the second portion of the second hinge member has at least one and in this example a pair of arcuate-shaped slots 161 and 163 extending therethrough in this example. The slots may be referred to as third and fourth slots of second hinge member 120. Arcuate-shaped slots 161 and 163 are spaced-apart. As seen in FIG. 3, arcuate-shaped slot 161 extends between a pair of spaced-apart end portions 173 and 175 of third portion 150 of second hinge member 120. Arcuate-shaped slot 163 extends between a pair of spaced-apart end portions 177 and 179 of the third portion of the second hinge member. End portions 173, 175, 177 and 179 are planar and outwardly concave in this example.

Second portion 130 of second hinge member 120 has a central aperture 164 extending through in this non-limiting embodiment, with the aperture aligning with an axis 166. Arcuate-shaped slots 161 and 163 have centers of curvature which are equal to each other and which align-with/correspond-to axis 166 in this example. The arcuate-shaped slots are thus coaxial with each other and aperture 164 in this example. As seen in FIG. 6, end portions 173 and 179 and aperture 164 align with each other in this example. End portions 175 and 177 and aperture 164 also align with each other in this example. Each slot 161 and 163 comprises a quarter of a circular path in this non-limiting embodiment; however, this is not strictly required.

As seen in FIG. 7, second hinge member 120 includes a fifth portion 156. The fifth portion of the second hinge member is configured to promote positioning in place of the second hinge member and/or third portion 150 thereof and/or selective coupling of the second hinge member to tabletop 32. The following is a non-limiting embodiment which achieves this functionality.

Fifth portion 156 of second hinge member 120 in this example is planar and may be referred to as a fifth planar portion of the second hinge member. However this is not strictly required and the fifth portion may comprise other shapes in other embodiments. As seen in FIG. 3, fifth portion 156 of second hinge member 120 has in this example spaced-apart rounded corners 167 and 169 positioned along distal end 171 thereof; however, this is not strictly required. Referring back to FIG. 7, each portion 62, 70, 122, 130, 150, 152 and 156 is rectangular in this example; however, this is not strictly required. Fifth portion 156 of second hinge member 120 couples to and extends outwards from distal end 158 of third portion 150 of the second hinge member. The fifth portion of the second hinge member in this non-limiting embodiment operatively connects to the third portion of the second hinge member so as to form a unitary whole. Third portion 150 of second hinge member 120 couples to and extends between fourth and fifth portions 152 and 156 of the second hinge member. The fifth portion of the second hinge member extends parallel to first portion 122 of the second hinge member in this non-limiting embodiment.

As seen in FIG. 9, fifth portion 156 of second hinge member 120 includes at least one and in this example a pair of spaced-apart apertures 160 and 162 extending therethrough. Apertures 160 and 162 in this example align adjacent sides 157 and 159 of the second hinge member, respectively. As seen in FIG. 4, fifth portion 156 of second hinge member 120 in this non-limiting embodiment extends horizontally, with the second hinge member thus extending horizontally at least in part. Hinge assembly 54 in this example includes a plurality of fasteners 168 which extend through apertures 160 and 162 seen in FIG. 6 and via which fifth portion 156 of second hinge member 120 couples to underside 33 of tabletop 32 seen in FIG. 4. However, this is not strictly required and the fasteners may be separate from and/or sold separately from the hinge assembly in other embodiments and/or may comprise third party fasteners. Second hinge member 120 in this example thus couples to the underside of the tabletop via a plurality of fasteners 128 and 168 which extend through respective apertures of first and fifth portions 122 and 156 thereof.

As seen in FIG. 3, the second hinge member is formed in this non-limiting embodiment by a blank 119. The blank is planar, has a longitudinal axis 121 and is generally rectangular in this example. Blank 119 is configured to be bent along laterally-extending and longitudinally spaced-apart bend or line portions 123, 125, 127 and 129. The bend lines between sides 157 and 159 of second hinge member 120 and are positioned to shape second hinge member 120 and form portions 122, 130, 152, 150 and 156, respectively. Still referring to FIG. 3, hinge knuckles 132, 134 and 136 in this example are formed by a plurality of tooth-shaped portions 133, 135 and 137 of blank 119. The tooth-shaped portions are longitudinally-extending and rectangular in shape in this example. Tooth-shaped portions 133, 135 and 137 of blank 119 extend outwards from proximal end 139 of first portion 122 of second hinge member 120 in this example. Each of the tooth-shaped portions is rolled or folded about itself so as to form a tubular shape in the form of hinge knuckles 132, 134 and 136 seen in FIG. 10.

As seen in FIG. 5, second, third and fourth portions 130, 150 and 152 of second hinge member 120 may be referred to as an angled member 154 of a brace 170. The angled member forms an inverse V-shape in side profile in this non-limiting embodiment. Second hinge member 120 is thus V-shaped at least in part in side profile in this example. The second hinge member is both L-shaped at least in part (portions 122 and 130 thereof) and V-shaped at least in part (portions 130, 150 and 152 thereof) in side profile in this example. Referring to FIG. 4, first and fifth portions 122 and 156 of second hinge member 120 may be referred to as a pair of spaced-apart inner and outer flanges or end portions of brace 170 that couple to underside 33 of tabletop 32 and which couple to and extend outwards from angled member 154 of brace 170.

Referring back to FIG. 5, the angled member of the brace may be said to include a first portion (second portion 130 of second hinge member 120) that extends outwards from the inner flange (first portion 122 of the second hinge member) and may be said to include a second portion (third portion 150 of the second hinge member) which extends between the outer flange (fifth portion 156 of the second hinge member) and the inner flange at acute angles relative thereto. Angled member 154 of brace 170 may thus be said to be angled relative to the rest of second hinge member 120, namely, first and fifth portions 122 and 156.

As seen in FIG. 4, the angled member of the brace (at least second, third and fourth portions 130, 150 and 152 of second hinge member 120) extends outwards from underside 33 of tabletop 32 relative to the rest of second hinge member 120 (first and/or fifth portions 62 and 156 thereof) at acute angles $ö_1$ and $ö_2$ relative to the tabletop. As seen in FIG. 5, angled member 154 of brace 170 extends outwards relative to the rest of the second hinge member (first and/or fifth portions 122 and 156 thereof) via at least one and in this example two obtuse angles $\psi_1$ and $\psi_2$ relative to the rest of the second hinge member (first and/or fifth portions 122 and 156 thereof). Second hinge member 120 may thus be said to include proximal and distal end portions (first and fifth portions 122 and 156 thereof) extending parallel to each other with angled member 154 (or an angled portion) which couples and extends outwards from the end portions at obtuse angles $\psi_1$ and $\psi_2$ relative to the end portions thereof.

As seen in FIG. 4, brace 170 includes at least one and in this example a plurality of angled portions (second, third and/or fourth portions 130, 150 and 152 of second hinge member 120) and a portion 172 of tabletop 32 coupled thereto. The brace is thus generally triangular in side profile at least in part. Brace 170 and portion 172 of table so coupled together form a triangular prism in outer shape and/or a truss 181. Second hinge member 120 in use is thus triangular at least in part in side profile. The second hinge member may thus be or form a wedge shape at least in part. Brace 170 thus includes at least one angled portion (third portion 150 of second hinge member 120) which faces downwards and outwards relative to tabletop 32. The brace in this non-limiting embodiment includes at least one angled portion (fourth portion 152 of the second hinge member) which faces downwards and inwards relative to the tabletop. Brace 170 tapers in a direction 174 extending from leg 40 towards peripheral portion 36 of tabletop 32.

Alternatively and referring to FIG. 5, second, third, fourth and fifth portions 130, 150, 152 and 156 of second hinge member 120 may be considered and referred to as a brace which couples to first portion 122 of the second hinge member. The brace in this case is thus positioned between second hinge member 120 (first portion 122 thereof) and peripheral portion 36 of tabletop 32 seen in FIG. 4.

In each of the above non-limiting embodiments, hinge assembly 54 may thus be said to include brace 170. The brace may be said to couple to and/or be integrally formed with one of the hinge members, in this example second hinge member 120 (first portion 122 thereof). Brace 170 is integrally connected to and formed with the hinge mechanism in this example. Assembly 54 may thus be referred to as a combination brace and hinge assembly.

Referring to FIG. 8, hinge assembly 54 in this non-limiting example includes a locking mechanism; however, this is not strictly required. The locking mechanism is configured to inhibit movement of and/or angular separation of first hinge member 60 relative to second hinge member 120. The locking mechanism may also be configured to be self-tightening. The following is a non-limiting embodiment which may achieve these functionalities.

Hinge assembly 54 in this example includes a locking mechanism in the form of a latching mechanism 176. The latching mechanism includes a female member, in this example a latch keeper 178. The latch keeper in this non-limiting embodiment is an irregular pentagon in outer profile in this example; however, this is not strictly required and the latch keeper may be elongate and/or have other shapes in other embodiments. Latch keeper 178 couples to a first of first hinge member and second hinge member, in this example coupling to and extending outwards from second portion 70 of first hinge member 60. The latch keeper in this non-limiting embodiment couples to the first hinge member via fasteners 81 and 83 extending through apertures 80 and 82 seen in FIG. 10. However, this is not strictly required and latch keeper 178 may be welded and/or coupled to first hinge member 60 in other manners in other embodiments. As seen in FIG. 8, the latch keeper is centrally positioned between sides 61 and 63 of first hinge member 60 in this example. Latch keeper 178 has a bottom 180 positioned adjacent to and extending outwards-from/perpendicular to distal end 87 of second portion 70 of the first hinge member in this non-limiting embodiment.

The latch keeper is angled relative to first hinge member 60 in this example. Slot 155 of second hinge member 120 seen in FIG. 8 is shaped to selectively enable latch keeper 178 to extend at least in part therethrough when hinge members 60 and 120 are in their nested positions seen in FIG. 4. Referring to FIG. 8, the latch keeper has an angled surface 182 which extends outwards from bottom 180 thereof at an obtuse angle ρ in this example. As seen in FIG. 4, angled surface 182 of latch keeper 178 is shaped to align and extend flush with third portion 150 of second hinge member 120 in this example when the hinge members 60 and 120 are in their nested position. Referring back to FIG. 8, the latch keeper includes a body 184 and an aperture 186 extending laterally therethrough. The aperture is rectangular in side profile; however, this is not strictly required. Aperture 186 extends laterally between sides 61 and 63 of first hinge member 60.

Figure 11:
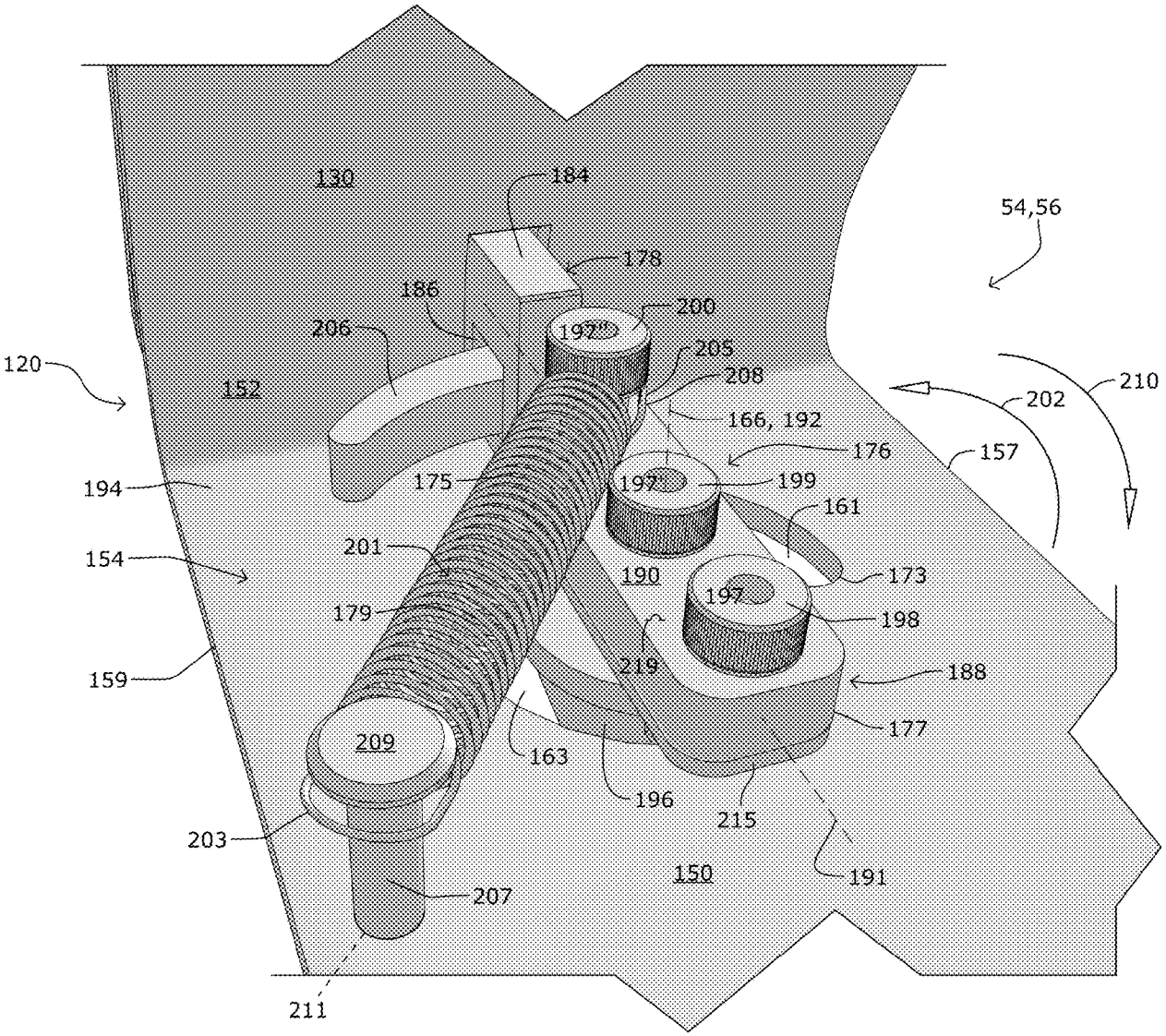
FIG. 11 is a top perspective view thereof showing the latching mechanism of the hinge assembly in the latched position, with the latch pivotally coupled to the second hinge member, with the latching mechanism including a latch keeper coupled to the first hinge member, and with the first hinge member and second hinge member shown in fragment.

As seen in FIG. 11, latching mechanism 176 includes a male member, in this example a latch 188. The latch operatively couples to and is selectively moveable at least in part relative to a second of first and second hinge members 60 and 120, in this example the second hinge member, so as to selectively engage with and/or couple to latch keeper 178. The following is a non-limiting embodiment which may achieve this functionality.

Latch 188 in this non-limiting example is configured to rotatably couple to and be slidable relative to third portion 150 of second hinge member 120. The latch in this example includes an elongate member or latch bar 190. The latch bar may be referred to as a latch plate. Latch bar 190 is generally a rectangular prism in shape in this non-limiting embodiment; however, the latter is not strictly required. The latch bar extends along a longitudinal axis 191. Latch bar 190 pivotally couples to a second of first hinge member 60 and second hinge member 120, in this example coupling to third portion 150 of the second hinge member. The latch bar has an axis of rotation 192. The axis of rotation of latch 188 is coaxial with axis 166 and arcuate-shaped slots 161 and 163 of third portion 150 of second hinge member 120 in this example.

Still referring to FIG. 11, latch bar 190 extends along a first or inner side or enclosure 194 of second hinge member 120 in this example. As seen in FIG. 9, latching mechanism 176 includes a handle 196. The handle is elongate and extends parallel to longitudinal axis 191 of latch bar 190 in this example seen in FIG. 9. Referring back to FIG. 9, handle 196 also extends generally along and parallel to third portion 150 of second hinge member 120; however, this is not strictly required. The handle extends along a second or outer side or exterior 204 of the second hinge member 120 opposite enclosure 194.

The handle couples to latch bar 190 via connecting members extending through arcuate-shaped slots 161 and 163, in this example first, second and third fasteners, in this case in the form of first bolt 198, second bolt 199 and third bolt 200 seen in FIG. 11. The bolts are longitudinally spaced-apart and align longitudinally with each other in this non-limiting embodiment. First bolt 198 extends through arcuate-shaped slot 163 in this example and is most spaced-apart from second portion 130 and fourth portion 152 of second hinge member 120 compared to second and third bolts 199 and 200. As seen with reference to FIGS. 11 and 12, the first bolt is selectively moveable along a path defined by arcuate-shaped slot 163 between end portions 177 and 179.

As seen in FIG. 11, second bolt 199 extends along axis of rotation 192 and through central aperture 164 seen in FIG. 3 in this example. The second bolt is coaxial with axes 166 and 192 in this example.

Third bolt 200 extends through arcuate-shaped slot 161 in this example and is positioned near or closer to second portion 130 and fourth portion 152 of second hinge member 120 compared to first and second bolts 198 and 199. As seen with reference to FIGS. 11 and 12, the third bolt is selectively moveable along a path defined by arcuate-shaped slot 161 between end portions 173 and 175. Bolts 198, 199 and 200 include enlarged end portions, in this case fastener or bolt heads 197, 197' and 197". The bolt head of third bolt 200 in this non-limiting embodiment is more spaced-apart from latch bar 190 and third portion 150 of second hinge member 120 compared to the bolt heads of the first and second bolts in this example. As seen with reference to FIGS. 11 and 12, bolts 198, 199 and 200 and arcuate-shaped slots 161 and 163 are configured to enable latch 188 to rotatably couple to and be slidable relative to third portion 150 of second hinge member 120. Latching mechanism 176 as herein described may thus be integrally connected to and/or formed with hinge assembly 54; however, this is not strictly required.

Referring back to FIG. 11, latch 188 is selectively actuated via rotation of handle 196 in a first direction of rotation 202 so as to cause the latch to extend through aperture 186 and couple with latch keeper 178, with hinge members 60 and 120 coupling together thereby. The latch is configured and/or includes a mechanism in this example to inhibit inadvertent decoupling of the latch and the latch keeper. The following is a non-limiting embodiment which may achieve this functionality.

Latching mechanism 176 includes a resilient member in the form of a coil spring, in this example an extension coil spring 201; however, this is not strictly required. The coil spring has a first end portion 203 and a second end portion 205 spaced-apart from the first end portion thereof. Each end portion of coil spring 201 is loop-shaped in this non-limiting embodiment. First end portion 203 of the coil spring operatively or pivotally couples to third portion 150 of second hinge member 120 via an elongate member, in this example protuberance 207. The protuberance couples to and extends outwards from the second hinge member. Protuberance 207 in this example includes a proximal end portion 211 seen in FIG. 7. The proximal end portion of the protuberance is threaded and configured to threadably couple to third portion 150 of second hinge member 120 via threaded aperture 213. The threaded aperture is positioned adjacent side 159 of the second portion of the second hinge member in this example. As seen in FIG. 8, proximal end portion 211 of protuberance 207 includes an engagement feature, in this example a tool bit engagement feature, in this case a recessed portion or slot 217. The slot when engaged by an engagement tool such as a tool bit or screw driver (not shown) enables selective adjustment of the positioning of the protuberance relative to third portion 150 of second hinge member 120.

Referring to FIG. 11, protuberance 207 extends perpendicular from third portion 150 of second hinge member 120 in this example; however, this is not strictly required. The protuberance is cylindrical in shape in this non-limiting example with an enlarged distal end 209 shaped to inhibit first end portion 203 of coil spring 201 from dislodging therefrom and sliding therepast. Protuberance 207 may be referred to as a binding post. The protuberance is configured to position coil spring 201 clear at least in part of bolt heads 197 and 197' of bolts 198 and 199 in this non-limiting embodiment. The protuberance is shaped to position coil spring 201 above and/or spaced from bolt heads 197 and 197' of bolts 198 and 199 in this example.

Second end portion 205 of coil spring 201 couples to and in this non-limiting embodiment pivotally connects to third bolt 200. The second end portion of the coil spring is positioned between latch bar 190 and bolt head 197" in this example, with the bolt head being shaped to inhibit the second end portion of the coil spring from dislodging therefrom or sliding therepast. Bolt 200 thus functions as an anchor for the other end of coil spring 201. The bolt extends past outer surface 219 of latch bar 190 to position coil spring 201 above bolt heads 197 and 197' of bolts 198 and 199.

As seen in FIG. 11, latch 188 includes a latch member, protrusion or catch 206 in this non-limiting embodiment. The catch couples to a distal end 208 of latch bar 190 thereof in this example; however, this is not strictly required and the catch may couple to the latch bar at other locations thereallong in other embodiments. Catch 206 is integrally formed with the latch bar so as to form a unitary whole in this example; however, this is not strictly required. Third bolt 200 and second end portion 205 of coil spring 201 are positioned adjacent the catch in this example. Catch 206 is arcuate-shaped in this example, with latch 188 thus being arcuate-shaped at least in part; however, this is not strictly required. Catch 206 may be referred to as an arcuate-shaped portion of latch 188. The catch has a curvature which extends about an axis that is coaxial with axis of rotation 192 of the latch in this example. The center of curvature of catch 206 is substantially equal to that of arcuate-shaped slots 161 and 163 of third portion 150 of second hinge member 120 in this example.

As seen in FIG. 11, latch 188 is configured to be slidable relative to third portion 150 of second hinge member 120 in this example via a slidable member, in this case spacer 215; however, the latter is not strictly required. The spacer couples to and in this non-limiting embodiment is co-extensive with latch bar 190; however, the latter is not strictly required. Spacer 215 is configured to abut and selectively slidably extend along third portion 150 of second hinge member 120 via an outer surface thereof. The outer surface of the spacer is configured to be smooth and/or have a low coefficient of friction so as to promote slidable engagement/movement with the third portion of the second hinge member.

Latching mechanism 176 has a locked or latched position in which, upon hinge members 60 and 120 being positioned in the nested position seen in FIG. 9 and upon rotation of handle 196 along first direction of rotation 202 seen in FIG. 11, catch 206 of latch 188 selectively extends through aperture 186 and engages with latch keeper 178. The latch is configured to selectively couple with the latch keeper so as to promote a fixed positioning of the first hinge member relative to the second hinge member in the latched position thereof. Latch 188 in the latched position is configured to inhibit movement of and/or angular separation of first hinge member 60 relative to second hinge member 120.

Referring to FIG. 9, latching mechanism 176 is configured to self-tighten as first and second portions 62 and 70 of first hinge member 60 are moved towards first and second portions 122 and 130 of second hinge member 120. Catch 206 seen in FIG. 11 so protruding outwards from latch keeper 178 and aperture 186 thereof, may function with its length and/or weight thereof to promote tightening and/or movement of latch 188 in direction of rotation 202 and/or towards the latched position in this non-limiting embodiment. Coil spring 201 is configured to bias the catch so as to extend through the latch keeper and aperture thereof so as to promote tightening and/or movement of the latch in direction of rotation 202 and/or towards the latched position. As seen in FIG. 9, latching mechanism 176 so configured to self-tighten may function to help gravity keep adjacent surfaces of hinge members 60 and 120 in full contact and may function to also aid in maintaining the sturdiness of the table.

Referring to FIG. 11, longitudinal axis 191 of latch bar 190 extends parallel to sides 157 and 159 of third portion 150 of second hinge member 120 in this non-limiting embodiment when latching mechanism 176 is in the latched position; however, this is not strictly required. First and third bolts 198 and 200 are positioned to abut and/or be near end portions 177 and 175, respectively, when the latching mechanism is in the latched position in this example. Coil spring 201 is configured to hold latching mechanism 176 in the latched position or inhibit/provide-resistance-to-the opening/dislodging of the latching mechanism when the latching mechanism is in the latched position seen in FIG. 11. The coil spring is configured to exert a first spring force 201A that is tangential at least in part and/or perpendicular to axis 191 and in a locking direction or the direction of rotation 202 when latching mechanism 176 is in the latched position, thereby inhibiting inadvertent dislodgement of catch 206 from latch keeper 178.

Figure 12:
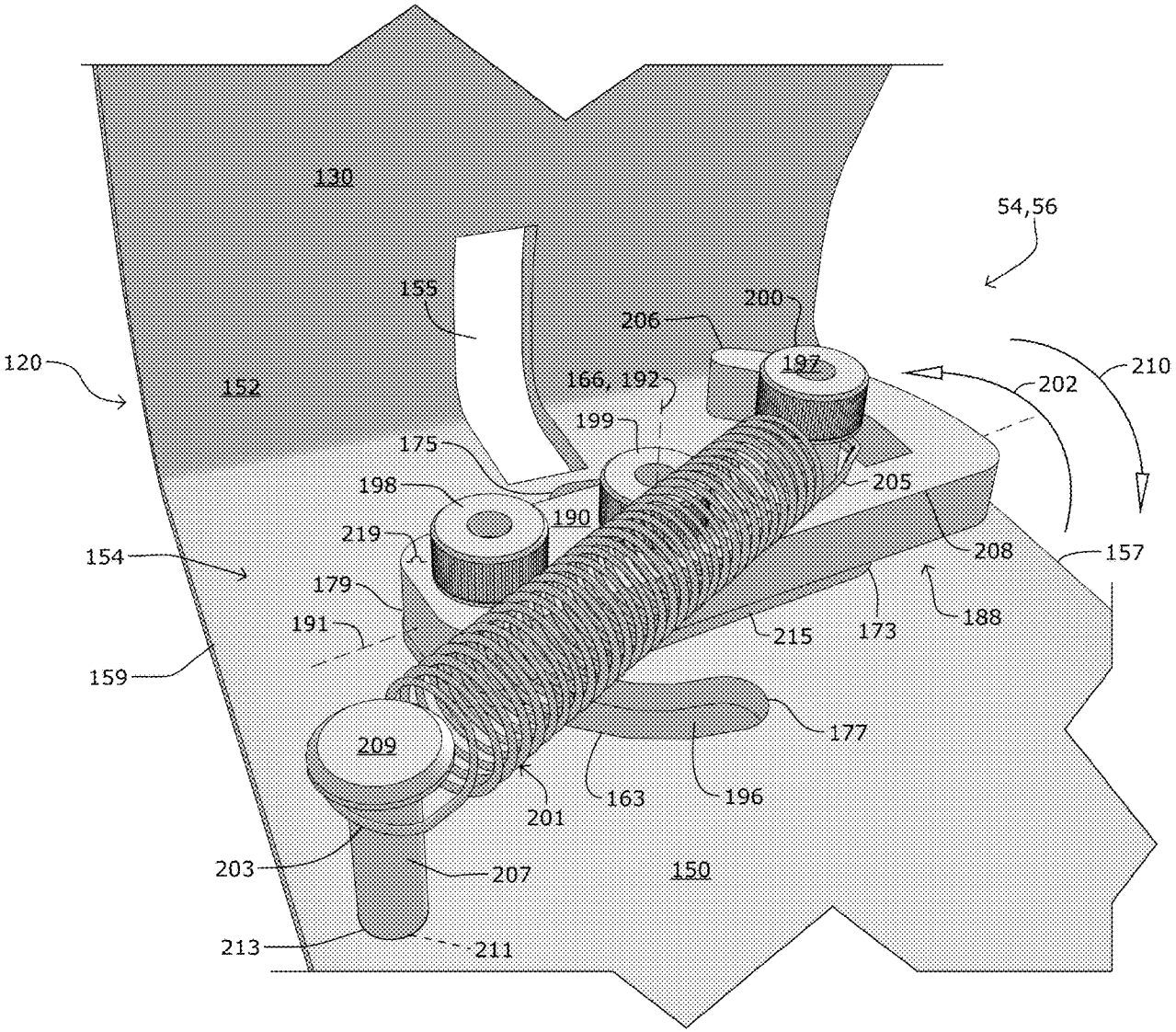
FIG. 12 is a top perspective view thereof similar to FIG. 11 and showing the latching mechanism of the hinge assembly in the unlatched position, with the first hinge member and second hinge member shown in fragment.

The latching mechanism is moveable from the latched position seen in FIG. 11 to an unlocked or unlatched position seen in FIG. 12. Spacer 215 is configured to facilitate rotation of latching mechanism 176 from the latched position seen in FIG. 11 to the unlatched position seen in FIG. 12 and vice versa, smoothing rotation of latch 188 thereby. Catch 206 of latch 188 is moved via handle 196 (as seen by arrow 210) so as to be spaced from latch keeper 178 in the unlatched position.

As seen in FIG. 12, longitudinal axis 191 of latch bar 190 extends between sides 157 and 159 of third portion 150 of second hinge member 120 in this example when latching mechanism 176 is in the unlatched position; however, this is not strictly required. First and third bolts 198 and 200 are positioned to abut and/or be near end portions 179 and 173, respectively, when the latching mechanism is in the unlatched position in this example. Coil spring 201 is configured to hold open latching mechanism 176 or inhibit/provide-resistance-to-the closing of the latching mechanism when the latching mechanism is in the open position or unlatched position seen in FIG. 12. The coil spring is configured to exert a second spring force that is tangential at least in part and/or perpendicular to axis 191 and in an unlocking direction or direction of rotation 210 when latching mechanism 176 is in the unlatched position, thereby inhibiting inadvertent coupling together of catch 206 and latch keeper 178 and/or ensuring that the catch is spaced from slot 155 in the unlatched position.

Coil spring 201 is thus configured to provide resistance if latch 188 is in between the latched position seen in FIG. 11 and unlatched position seen in FIG. 12. Coil spring 201 may be configured to be most stretched/extended/elongate in between the latched and unlatched positions with the distal end of catch 206 adjacent to aperture 186. However, this is not strictly required. Spring 201 is configured to align with and extend parallel to longitudinal axis 191 of latch 188 when the spring is in its most stretched/extended/elongate in between the latched and unlatched positions in this non-limiting embodiment.

Referring to FIG. 5, assembly 54 as herein described may thus effectively combine hinge 56, brace 170 and locking/latching mechanism 176 into one unit for ease of use and installation. Referring to FIG. 1, Folding table 30 and the hinge assembly as herein described may result in a table with improved sturdiness of legs 40 and 42 thereof. Assembly 54 as herein described may as a result comprise relatively few parts and may thus promote ease of and facilitate installation in a time effective manner. The latter may be particularly useful for hospitality events and the like, where a large number of tables may need to be selectively deployed and thereafter stored when no longer needed.

Assembly 54 as herein described may be relatively more hidden from view from those sitting around the table, thereby resulting in a table that may have greater aesthetic appeal. When legs 40 and 42 are unfolded, that is, when table 30 is set up for use, hinge members 60 and 120 are thus shaped to not be visible, so that the table may have an aesthetic beauty similar to a non-folding table. Assembly 54 in this non-limiting embodiment is configured to have a low enough profile to be hidden behind a standard sized table skirt on the one hand, while being configured with its brace 170 to support leg in the deployed position on the other hand. The brace functions to inhibit outward movement of the leg past the deployed position of the leg.

It will be appreciated that many variations are possible within the scope of the invention described herein.

Where a component (e.g. an apparatus, assembly etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms. These terms ("a", "an", and "the") mean one or more unless stated otherwise;

"and/or" is used to indicate one or both stated cases may occur, for example A and/or B includes both (A and B) and (A or B);

"approximately" when applied to a numerical value means the numerical value±10%;

where a feature is described as being "optional" or "optionally" present or described as being present "in some embodiments" it is intended that the present disclosure encompasses embodiments where that feature is present and other embodiments where that feature is not necessarily present and other embodiments where that feature is excluded. Further, where any combination of features is described in this application this statement is intended to serve as antecedent basis for the use of exclusive terminology such as "solely," "only" and the like in relation to the combination of features as well as the use of "negative" limitation(s)" to exclude the presence of other features; and "first" and "second" are used for descriptive purposes and cannot be understood as indicating or implying relative importance or indicating the number of indicated technical features.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a range for a value is stated, the stated range includes all sub-ranges of the range. It is intended that the statement of a range supports the value being at an endpoint of the range as well as at any intervening value to the tenth of the unit of the lower limit of the range, as well as any subrange or sets of sub ranges of the range unless the context clearly dictates otherwise or any portion(s) of the stated range is specifically excluded. Where the stated range includes one or both endpoints of the range, ranges excluding either or both of those included endpoints are also included in the invention.

Certain numerical values described herein are preceded by "about". In this context, "about" provides literal support for the exact numerical value that it precedes, the exact numerical value±5%, as well as all other numerical values that are near to or approximately equal to that numerical value. Unless otherwise indicated a particular numerical value is included in "about" a specifically recited numerical value where the particular numerical value provides the substantial equivalent of the specifically recited numerical value in the context in which the specifically recited numerical value is presented. For example, a statement that something has the numerical value of "about 10" is to be interpreted as: the set of statements:

in some embodiments the numerical value is 10;

in some embodiments the numerical value is in the range of 9.5 to 10.5;

and if from the context the person of ordinary skill in the art would understand that values within a certain range are substantially equivalent to 10 because the values with the range would be understood to provide substantially the same result as the value 10 then "about 10" also includes:

in some embodiments the numerical value is in the range of C to D where C and D are respectively lower and upper endpoints of the range that encompasses all of those values that provide a substantial equivalent to the value 10

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

As will be apparent to those of skill in the art upon reading this disclosure, each of the individual embodiments described and illustrated herein has discrete components and features which may be readily separated from or combined with the features of any other described embodiment(s) without departing from the scope of the present invention.

Any aspects described above in reference to apparatus may also apply to methods and vice versa.

Any recited method can be carried out in the order of events recited or in any other order which is logically possible. For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, simultaneously or at different times.

Various features are described herein as being present in "some embodiments". Such features are not mandatory and may not be present in all embodiments. Embodiments of the invention may include zero, any one or any combination of two or more of such features. All possible combinations of such features are contemplated by this disclosure even where such features are shown in different drawings and/or described in different sections or paragraphs. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible). This is the case even if features A and B are illustrated in different drawings and/or mentioned in different paragraphs, sections or sentences.

ADDITIONAL DESCRIPTION

Examples of folding tables and hinge assemblies have been described. The following clauses are offered as further description.

(1) A hinge comprising: a first hinge member that is L-shaped; and a second hinge member hingedly coupled to the first hinge member, the second hinge member being L-shaped at least in part.

(2) A hinge according to clause 1, or any preceding or subsequent clause, wherein the first hinge member is L-shaped in side profile and wherein the second hinge member is L-shaped at least in part in side profile.

(3) A hinge according to any one of clauses 1 to 2, or any preceding or subsequent clause, wherein the first hinge member and the second hinge member have a first position in which the first hinge member is angularly spaced from the second hinge member and wherein the first hinge member and the second hinge member are moveable from the first position to a second position in which the first hinge member is adjacent and extends along the second hinge member.

(4) A hinge according to any one of clauses 1 to 3, or any preceding or subsequent clause, wherein the first hinge member and the second hinge member have a first position in which the first hinge member is angularly spaced from the second hinge member and wherein the first hinge member and the second hinge member are moveable from the first position to a second position in which the first hinge member nests with the second hinge member.

(5) A hinge according to any one of clauses 1 to 4, or any preceding or subsequent clause, wherein the first hinge member and the second hinge member are moveable to selectively overlap with each other.

(6) A hinge according to any one of clauses 1 to 5, or any preceding or subsequent clause, each of the hinge members includes a first portion and a second portion coupled to and either perpendicular or slightly obtusely angled relative to the first portion thereof (7) A hinge according to clause 6, or any preceding or subsequent clause, wherein the first hinge member is moveable relative to the second hinge member such that the first portions of the hinge members extend adjacent and parallel with each other and the second portions of the hinge members extend adjacent and parallel with each other.

(8) A hinge assembly according to any one of clauses 6 to 7 or any clause herein, wherein the first portion of the first hinge member is planar.

(9) A hinge assembly according to any one of clauses 6 to 8 or any clause herein, wherein the second portion of the first hinge member is planar.

(10) A hinge assembly according to any one of clauses 6 to 9 or any clause herein, wherein the first portion of the second hinge member is planar.

(11) A hinge assembly according to any one of clauses 6 to 10 or any clause herein, wherein the second portion of the second hinge member is planar.

(12) A hinge assembly according to any one of clauses 1 to 11 or any clause herein, wherein each said portion is rectangular.

(13) A hinge assembly according to any one of clauses 1 to 12, or any preceding or subsequent clause, wherein the second hinge member is wedge-shaped at least in part.

(14) A hinge assembly according to any one of clauses 1 to 13, or any preceding or subsequent clause, wherein the first hinge member comprises a first hinge leaf and the second hinge member comprises a second hinge leaf

(15) A hinge assembly according to any one of clauses 1 to 14, or any preceding or subsequent clause, wherein the first hinge member includes a plurality of laterally spaced-apart hollow protrusions with recessed portions therebetween, wherein the second hinge member includes a plurality of laterally spaced-apart hollow protrusions positioned to fit within respective said recessed portions, and wherein the hinge includes a pin member shaped to extend through said hollow protrusions, with the first hinge member and the second hinge member pivotally coupling together thereby.

(16) A hinge assembly according to any one of clauses 1 to 15, or any preceding or subsequent clause, including a female member coupled to a first of the first hinge member and the second hinge member and including a male member coupled to a second of the first hinge member and the second hinge member, the male member being configured to selectively couple with the female member so as to promote a fixed positioning of the first hinge member relative to the second hinge member.

(17) A hinge comprising: a first hinge member; a female member coupled to the first hinge member; a second hinge member hingedly coupled to the first hinge member; and a male member pivotally coupled to the second hinge member, the male member being configured to selectively engage with the female member, with movement of the first hinge member relative to the second hinge member being inhibited thereby.

(18) A hinge according to clause 17, or any preceding or subsequent clause, wherein the female member is coupled to and extends outwards from the first hinge member and wherein the second hinge member has a slot shaped to selectively enable the female member to extend at least in part therethrough.

(19) A hinge according to any one of clauses 17 to 18, or any preceding or subsequent clause, including a handle coupled to and via which the male member is selectively actuated.

(20) A hinge according to clause 19, or any preceding or subsequent clause, including one or more of: wherein the handle enables the male member to be selectively rotated from a locked position, in which the male member selectively engages with the female member, to an unlocked position, in which the male member spaced from the female member; wherein the hinge includes a resilient member configured to inhibit movement of the male member from the locked position to the unlocked position and vice versa; wherein the resilient member is configured to provide the most resistance and/or be most stretched/elongate between the unlocked position and the locked position; and wherein the hinge includes a sliding member which facilitates movement of the male member from the locked position to the unlocked position and vice versa.

(21) A hinge according to any one of clauses 19 to 20, or any preceding or subsequent clause, wherein the male member extends along a first side of the second hinge member and wherein the handle extends along a second side of the second hinge member opposite the first side of the second hinge member

(22) A hinge according to any one of clauses 19 to 21, or any preceding or subsequent clause, wherein the second hinge member has one or more arcuate-shaped slots via which the handle and the male member couple together.

(23) A hinge according to clause 22, or any preceding or subsequent clause, wherein the male member has an axis of rotation which is coaxial with the one or more arcuate-shaped slots.

(24) A hinge according to any one of clauses 19 to 21, or any preceding or subsequent clause, wherein the second hinge member has a pair of opposed, arcuate-shaped slots via which the handle and the male member couple together and wherein the male member has an axis of rotation which is coaxial with said arcuate-shaped slots.

(25) A hinge according to any one of clauses 17 to 24, or any preceding or subsequent clause, wherein the male member is arcuate-shaped at least in part.

(26) A hinge according to any one of clauses 17 to 24, or any preceding or subsequent clause, wherein the male member includes an arcuate-shaped portion.

(27) A hinge according to clause 26 or any preceding or subsequent clause, wherein the arcuate-shaped portion of the male member is coaxial with the axis of rotation of the male member.

(28) A hinge according to any one of clauses 26 to 27, or any preceding or subsequent clause, wherein the arcuate-shaped portion of the male member is coaxial with the one or more arcuate-shaped slots of the second hinge member.

(29) A hinge according to any one of clauses 17 to 28, or any preceding or subsequent clause, wherein the male member is a latch and wherein the female member is a latch keeper.

(30) A hinge according to clause 29, or any preceding or subsequent clause, wherein the latch keeper is angled relative to the first hinge member.

(31) A hinge according to any one of clauses 29 to 30, or any preceding or subsequent clause, wherein the latch keeper is an irregular pentagon in outer profile.

(32) A hinge comprising: a first hinge member including a first portion and a second portion coupled and extending either perpendicular or slightly obtusely angled relative to the first portion thereof; a second hinge member including a first portion hingedly coupled to the first portion of the first hinge member, the second hinge member including a second portion coupled and extending either perpendicular or slightly obtusely angled relative to the first portion thereof, and the second hinge member including a third portion angularly spaced-apart from and coupled to the first portion thereof via the second portion thereof.

(33) A hinge according to clause 32 or any clause herein, wherein the first portion of the first hinge member is planar.

(34) A hinge according to any one of clauses 32 to 33 or any clause herein, wherein the second portion of the first hinge member is planar.

(35) A hinge according to any one of clauses 32 to 34 or any clause herein, wherein the first portion of the second hinge member is planar.

(36) A hinge according to any one of clauses 32 to 35 or any clause herein, wherein the second portion of the second hinge member is planar.

(37) A hinge according to any one of clauses 32 to 36, or any preceding or subsequent clause, wherein the third portion of the second hinge member is angled relative to the second portion of the second hinge member.

(38) A hinge according to any one of clauses 32 to 37, or any preceding or subsequent clause, wherein the third portion of the second hinge member extends outwards at an acute angle relative to the second portion of the second hinge member.

(39) A hinge according to any one of clauses 32 to 38, or any preceding or subsequent clause, wherein the third portion of the second hinge member is shaped to inhibit movement of the second portion of the second hinge member relative to the first portion of the second hinge member.

(40) A hinge according to any one of clauses 32 to 39 or any clause herein, wherein the third portion of the second hinge member is planar.

(41) A hinge according to any one of clauses 32 to 40, or any preceding or subsequent clause, wherein the second hinge member includes a fourth portion which couples together and which is angled relative to the second portion thereof and the third portion thereof.

(42) A hinge according to any clause 41 or any clause herein, wherein the fourth portion of the second hinge member is planar.

(43) A hinge according to any one of clauses 41 to 42, or any preceding or subsequent clause, wherein the second hinge member includes a fifth portion coupled to and extending outwards from the third portion thereof

(44) A hinge according to any clause 43 or any clause herein, wherein the fifth portion of the second hinge member is planar.

(45) A hinge according to any one of clauses 32 to 44, or any preceding or subsequent clause, wherein the third portion of the second hinge member is a first angled portion of the second hinge member and wherein the second hinge member includes a second angled portion which couples together and which is angled relative to the second portion thereof and the first angled portion thereof

(46) A hinge according to any one of clauses 32 to 45, or any preceding or subsequent clause, wherein the second hinge member includes a flange coupled to a distal end of the third portion thereof.

(47) A hinge according to clause 46 or any preceding or subsequent clause, wherein the flange extends parallel to the first portion of the second hinge member.

(48) A hinge according to any one of clauses 46 to 47, or any preceding or subsequent clause, wherein the flange has one or more apertures extending therethrough.

(49) A hinge according to any one of clauses 46 to 47, or any preceding or subsequent clause, wherein the flange has a pair of spaced-apart apertures extending therethrough.

(50) A hinge according to any one of clauses 1 to 31, or any preceding or subsequent clause, wherein each of the first hinge member and the second hinge member has a plurality of apertures extending therethrough.

(51) A hinge according to any one of clauses 32 to 47, or any preceding or subsequent clause, wherein each said first portion of the first hinge member and the second hinge member has a plurality of apertures extending therethrough.

(52) A hinge according to any one of clauses 1 to 51, or any preceding or subsequent clause, wherein each of the first hinge member and the second hinge member is made of metal plate.

(53) A hinge comprising: a first hinge member; a second hinge member hingedly coupled to the first hinge member; and a latching mechanism configured to self-tighten as the first hinge member is moved towards the second hinge member.

(54) A hinge assembly comprising: a first hinge member and a second hinge member hingedly coupled to the first hinge member; and a brace coupled to and integrally formed with one of the hinge members; and a locking mechanism comprising a female member coupled to one of the hinge members and a male member coupled to another of the hinge members.

(55) A hinge assembly comprising: a first hinge member; and a second hinge member hingedly coupled to the first hinge member, wherein one of the hinge members is V-shaped at least in part in side profile.

(56) A combination brace and hinge assembly comprising: a brace comprising a pair of spaced-apart flanges, an angled member coupled to and extending between the flanges thereof, and a plurality of laterally spaced-apart hollow protrusions with recessed portions therebetween, the hollow protrusions coupling to a distal end of one said flange; a hinge member including a plurality of laterally spaced-apart hollow protrusions positioned to fit within respective said recessed portions; and a pin member shaped to extend through said hollow protrusions, with the one said flange of the brace and the hinge member pivotally coupling together thereby.

(57) A combination according to clause 56, or any preceding or subsequent clause, wherein the hinge member is L-shaped is profile.

(58) A combination according to any one of clauses 56 to 57, or any preceding or subsequent clause, wherein the angled member is V-shaped in side profile.

(59) A combination according to any one of clauses 56 to 58, or any preceding or subsequent clause, wherein the angled member includes a first portion that extends outwards from the one said flange and includes a second portion which extends between the other said flange and the first portion at acute angles relative thereto.

(60) A folding table comprising: a tabletop; at least one hinge according to any one clauses 1 to 31; and at least one leg coupled to the tabletop via the at least one hinge.

(61) A folding table according to clause 60, or any preceding or subsequent clause, wherein the first hinge member of the hinge couples to an end and an outer side of the leg.

(62) A folding table according to any one of clauses 60 to 61, or any preceding or subsequent clause, wherein the second hinge member couples to an underside of the tabletop.

(63) A folding table comprising: a tabletop; at least one hinge according to any one clauses 32 to 51, and at least one leg coupled to the tabletop via the at least one hinge.

(64) A folding table according to clause 63, or any preceding or subsequent clause, wherein the first portion of the first hinge member couples to and extends along an end of the leg and wherein the second portion of the first hinge member couples to and extends along an outer side of the leg.

(65) A folding table according to any one of clauses 63 to 64, or any preceding or subsequent clause, wherein the leg is moveable relative to the tabletop via the hinge from a stored position to a deployed position.

(66) A folding table according to clause 65, or any preceding or subsequent clause, wherein the first portion of the first hinge member extends vertically when the leg is in the stored position and wherein the second portion of the first hinge member extends horizontally when the leg is in the stored position.

(67) A folding table according to any one of clauses 64 to 66 or any preceding or subsequent clause, wherein the first portion of the first hinge member extends horizontally when the leg is in the deployed position and wherein the second portion of the first hinge member extends vertically when the leg is in the deployed position.

(68) A folding table according to any one of clauses 64 to 67 wherein the first portion of the second hinge member extends horizontally.

(69) A folding table according to any one of clauses 64 to 68 wherein the second portion of the second hinge member extends vertically.

(70) A folding table comprising: at least one leg; a tabletop; a first hinge member including first and second portions coupling to and extending at least in part along an end and an outer side of the leg, respectively; a second hinge member hingedly coupled to the first hinge member, the hinge members enabling the leg to move relative to the tabletop from a stored position to a deployed position, with the second hinge member abutting and extending along at least one of the first and second portions of the first hinge member in said deployed position.

(71) A folding table according to any preceding or subsequent clause, wherein the second hinge member includes a first portion which couples to an underside of the tabletop.

(72) A folding table according to any preceding or subsequent clause, including a brace which couples to the second hinge member and functions to inhibit outward movement thereof

(73) A folding table according to any preceding or subsequent clause, wherein the brace is angled relative to the second hinge member.

(74) A folding table according to any preceding or subsequent clause, wherein the brace extends from the tabletop to the second hinge member at an acute angle relative to the tabletop and/or the second hinge member.

(75) A folding table according to any preceding or subsequent clause, wherein the tabletop includes a peripheral portion and wherein the brace is positioned between the second hinge member and the peripheral portion of the tabletop.

(76) A folding table according to any preceding or subsequent clause, wherein the brace includes an angled portion which faces downwards and outwards relative to the tabletop.

(77) A folding table according to any preceding or subsequent clause, wherein the brace includes an angled portion and a portion of said tabletop coupled thereto.

(78) A folding table according to any preceding or subsequent clause, wherein the brace is triangular in side profile.

(79) A folding table according to any preceding or subsequent clause, wherein the brace tapers in a direction extending from the leg towards the peripheral portion of the tabletop.

(80) A folding table according to any preceding or subsequent clause, wherein the brace includes an outer flange which couples to the undersigned of the tabletop.

(81) A folding table according to any preceding or subsequent clause, wherein the hinge members cause the leg in the deployed position to extend outwards from the tabletop at a slightly obtuse angle relative to the tabletop.

(82) A folding table according to any preceding or subsequent clause, wherein the hinge members are configured such that the weight of the tabletop biases the leg outwards and such that the leg is inhibited from moving from the deployed position to the stored position thereof unless the tabletop is first lifted upwards.

(83) A folding table according to any preceding or subsequent clause, wherein the hinge members are configured to effectively increase the surface area of contact between the leg and the tabletop.

(84) A folding table comprising: a tabletop; at least one leg; a hinge mechanism coupled to the tabletop and the leg so as to enable the leg to move from a stored position to a deployed position; and a brace configured to support the leg in the deployed position, the brace being integrally connected to and formed with the hinge mechanism.

(85) A folding table comprising: a tabletop; at least one leg; a hinge mechanism coupled to the tabletop and the leg so as to enable the leg to move from a stored position to a deployed position; and a locking mechanism which when actuated is configured to inhibit movement of the leg from the deployed position to the stored position, the locking mechanism being integrally connected to and formed with the hinge mechanism.

(86) A hinge comprising: a first hinge member; and a second hinge member hingedly coupled to the first hinge member, wherein one of the hinge members is both L-shaped at least in part and V-shaped at least in part in side profile.

(87) A hinge comprising: a first hinge member; and a second hinge member hingedly coupled to the first hinge member, wherein one of the hinge members in use is triangular at least in part in side profile.

(88) A hinge comprising: a first hinge member; and a second hinge member hingedly coupled to the first hinge member, wherein one of the hinge members includes a proximal end portion, a distal end portion spaced-apart from the proximal end portion thereof, and an angled portion which couples and extends outwards from the end portions at obtuse angles relative to the end portions thereof

(89) A hinge according to any preceding or subsequent clause, wherein the angled portion is V-shaped in side profile.

(90) A hinge according to any preceding or subsequent clause, wherein the angled portion forms a receptacle spanning a space which is a triangular prism in shape.

(91) A hinge comprising: a first hinge member; and a second hinge member hingedly coupled to the first hinge member, wherein one of the hinge members includes spaced-apart end portions which extend parallel with each other and includes an angled portion extending therebetween.

(92) A hinge according to any preceding or subsequent clause, wherein the angled portion of the one of the hinge members comprises one or more bent sections.

(93) A hinge according to any preceding or subsequent clause, wherein the end portions of the one of the hinge members are shaped to couple with a planar member and wherein the bent portion of the one of the hinge members together with a portion of the planar member spanning the end portions, form a triangular prism in outer shape.

(94) A hinge according to any preceding or subsequent clause, wherein the end portions of the one of the hinge members are shaped to couple with a planar member and wherein the angled portion of the one of the hinge members together with a portion of the planar member spanning the end portions, form a truss.

(95) A hinge assembly according to any clause herein, wherein the first portion of the first hinge member is planar.

(96) A hinge assembly according to any clause herein, wherein the second portion of the first hinge member is planar.

(97) A hinge assembly according to any clause herein, wherein the first portion of the first hinge member is planar.

(98) A hinge assembly according to any clause herein, wherein the second portion of the first hinge member is planar.

(99) Apparatus including any new and inventive feature, combination of features, or sub-combination of features as described herein.

(100) Methods including any new and inventive steps, acts, combination of steps and/or acts or sub-combination of steps and/or acts as described herein.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A hinge assembly comprising:

a first hinge member;

a second hinge member hingedly coupled to the first hinge member; and a locking mechanism which selectively couples together the hinge members, wherein the locking mechanism includes a female member which couples to the first hinge member, wherein the locking mechanism includes a male member which pivotally couples to the second hinge member and selectively engages with the female member, with movement of the first hinge member relative to the second hinge member being inhibited thereby, wherein the locking mechanism includes a coil spring which exerts a first spring force at least in part in a locking direction when the locking mechanism is in a locked position, thereby promoting engagement of the male member with the female member, wherein the coil spring exerts a second spring force at least in part in an unlocking direction when the locking mechanism is in an unlocked position, thereby inhibiting engagement of the male member with the female member, and wherein the coil spring exerts a maximum spring force when the male member is between the unlocked position and the locked position.

2. A hinge assembly according to claim 1, wherein the second hinge member in outer shape is wedge-shaped at least in part.

3. A hinge assembly according to claim 1, wherein the second hinge member comprises spaced-apart end portions which extend parallel with each other and an angled portion coupled to and extending between said end portions.

4. A hinge assembly according to claim 1, wherein the first hinge member is connectable to a leg of a table, wherein the second hinge member includes an outer flange connectable to an underside of a tabletop, wherein the second hinge member includes an angled member coupled to the outer flange thereof, and wherein a brace which is generally triangular in outer side profile is formed by said angled member and a portion of the tabletop coupled thereto.

5. A hinge assembly according to claim 1, wherein the second hinge member includes a proximal end portion, a distal end portion spaced-apart from the proximal end portion thereof, and an angled portion which couples and extends outwards from said end portions at obtuse angles relative to said end portions.

6. A hinge assembly according to claim 1, wherein the second hinge member includes a first portion hingedly coupled to the first hinge member, a second portion coupled and extending outwards at an angle relative to the first portion thereof, and a third portion spaced apart from and coupled to the first portion thereof via the second portion thereof, wherein the third portion of the second hinge member couples to and extends outwards at an acute angle relative to the second portion of the second hinge member, and wherein the third portion of the second hinge member is shaped to inhibit movement of the second portion of the second hinge member relative to the first portion of the second hinge member.

7. A hinge assembly according to claim 6, wherein an outer flange of the second hinge member couples to a distal end of the third portion thereof, with the first portion and the outer flange of the second hinge member substantially extending in parallel with each other and being selectively connectable to and extendable along the table.

8. A hinge assembly according to claim 1, wherein the second hinge member has a slot shaped to selectively enable the female member to extend at least in part therethrough, and wherein the male member is shaped to selectively engage with the female member when extending at least in part through the second hinge member.

9. A hinge assembly according to claim 1, wherein the male member includes an arcuate-shaped latch shaped to selectively engage with the female member, with the latch having a center of curvature that is coaxial with an axis of rotation of the male member.

10. A hinge assembly according to claim 1, including a handle via which the male member is selectively rotatable from the locked position to the unlocked position, wherein the male member extends along a first side of the second hinge member and wherein the handle extends along a second side of the second hinge member opposite the first side of the second hinge member.

11. A hinge assembly according to claim 1, including a handle via which the male member is selectively rotatable from the locked position to the unlocked position, wherein the second hinge member has one or more arcuate-shaped slots via which the handle and the male member couple together, and wherein the male member has an axis of rotation which is coaxial with the one or more arcuate-shaped slots.

12. A hinge assembly comprising:

a first hinge member;

a second hinge member hingedly coupled to the first hinge member; and a locking mechanism which selectively couples together the hinge members, wherein the locking mechanism includes a female member which couples to the first hinge member, wherein the locking mechanism includes a male member which pivotally couples to the second hinge member and selectively engages with the female member, with movement of the first hinge member relative to the second hinge member being inhibited thereby, and wherein the male member comprises a hook which tapers from a proximal end to a distal end thereof, with movement of the hook from an unlocked position towards a locked position spring-biasing the hook towards the female member and functioning to increasingly wedge the hook into the female member.

13. A hinge assembly according to claim 12, wherein the hinge assembly connects a table leg to a bottom of a tabletop at an obtuse angle, causing the weight of the tabletop to bias the first and second hinge members towards each other, wherein the hinge assembly includes a coil spring connected to one said hinge member and the male member, with the coil spring biasing the male member towards the female member when in the locked position, thereby promoting engagement of the male member with the female member and inhibiting inadvertent dislodgement therefrom.

14. A hinge assembly according to claim 12, wherein the male member is rotatable about an axis of rotation, wherein the locking mechanism includes a coil spring with a proximal end portion which couples to the second hinge member and a distal end portion which couples to the male member at a location spaced from said axis of rotation, wherein the coil spring passes over said axis of rotation when the male member is between the locked and unlocked position, wherein the coil spring biases the male member towards the female member when the coil spring extends between said axis of rotation and the female member, and wherein the coil spring biases the male member away from the female member when said axis of rotation is between the female member and the coil spring.

15. A hinge assembly according to claim 12, wherein the hinge assembly connects a table leg to a bottom of a tabletop at an obtuse angle, causing the weight of the tabletop to bias the first and second hinge members towards each other, wherein the hinge assembly includes a coil spring connected to one said hinge member and the male member, with the coil spring biasing the male member towards the female member when in the locked position, thereby promoting engagement of the male member with the female member and inhibiting inadvertent dislodgement therefrom.

16. A hinge assembly according to claim 12, wherein the second hinge member has a slot shaped to selectively enable the female member to extend at least in part therethrough, and wherein the male member is shaped to selectively engage with the female member when extending at least in part through the second hinge member.

17. A hinge assembly comprising:

a first hinge member;

a second hinge member hingedly coupled to the first hinge member; and a locking mechanism which selectively couples together the hinge members, wherein the locking mechanism includes a female member which couples to the first hinge member, wherein the locking mechanism includes a male member which pivotally couples to the second hinge member and selectively engages with the female member, with movement of the first hinge member relative to the second hinge member being inhibited thereby, wherein the male member is rotatable from an unlocked position, in which the male member is spaced from the female member, to a locked position, in which the male member selectively engages with the female member, and wherein the locking mechanism includes a coil spring which is most stretched, extended and/or elongate in between said locked and unlocked positions.

18. A hinge assembly according to claim 17, wherein the male member is rotatable about an axis of rotation, wherein the coil spring includes a proximal end portion which couples to the second hinge member and a distal end portion which couples to the male member at a location spaced from said axis of rotation, wherein the coil spring passes over said axis of rotation when the male member is between the locked and unlocked position, wherein the coil spring biases the male member towards the female member when the coil spring extends between said axis of rotation and the female member, and wherein the coil spring biases the male member away from the female member when said axis of rotation is between the female member and the coil spring.

19. A hinge assembly according to claim 17, wherein the hinge assembly connects a table leg to a bottom of a tabletop at an obtuse angle, causing the weight of the tabletop to bias the first and second hinge members towards each other, wherein the coil spring is connected to one said hinge member and the male member, with the coil spring biasing the male member towards the female member when in the locked position, thereby promoting engagement of the male member with the female member and inhibiting inadvertent dislodgement therefrom.

20. A hinge assembly according to claim 17, wherein the second hinge member has a slot shaped to selectively enable the female member to extend at least in part therethrough, and wherein the male member is shaped to selectively engage with the female member when extending at least in part through the second hinge member.

* * * * *